US007881636B2

(12) United States Patent
Furuya et al.

(10) Patent No.: US 7,881,636 B2
(45) Date of Patent: Feb. 1, 2011

(54) BELT DRIVING DEVICE AND IMAGE FORMING APPARATUS

(75) Inventors: Masaharu Furuya, Kanagawa (JP); Takuya Sekine, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 383 days.

(21) Appl. No.: 12/003,139

(22) Filed: Dec. 20, 2007

(65) Prior Publication Data

US 2008/0175621 A1 Jul. 24, 2008

(30) Foreign Application Priority Data

Jan. 10, 2007 (JP) ..... 2007-002395

(51) Int. Cl.
*G03G 15/00* (2006.01)

(52) U.S. Cl. ..... 399/165

(58) Field of Classification Search ..... 399/165, 399/303; 341/13

See application file for complete search history.

(56) References Cited

U.S. PATENT DOCUMENTS 5,214,426 A * 5/1993 Minohara et al. ..... 341/13
5,634,169 A * 5/1997 Barry et al. ..... 399/12
7,277,667 B2 10/2007 Saito et al.
2005/0078991 A1 4/2005 Kimura et al.
2006/0104677 A1* 5/2006 Saito et al. ..... 399/301
2007/0058992 A1* 3/2007 Suzuki et al. ..... 399/12

FOREIGN PATENT DOCUMENTS

JP 03210573 A * 9/1991
JP 11026373 A * 1/1999
JP 2004-341413 12/2004
JP 2005-037620 2/2005
JP 2005-189599 7/2005
JP 2006-053194 2/2006

OTHER PUBLICATIONS

R.F. Dinan, D.A. Ramsey, C.F. Rohe, and T.E. Sawicky, "Code Tracking" in IBM Technical Disclosure Bulletin, vol. 25, No. 11B (Apr. 1, 1983) pp. 6074-6075. <IPCOM000045788D>.*

* cited by examiner

*Primary Examiner*—Constantine Hannaher
(74) *Attorney, Agent, or Firm*—Harness, Dickey & Pierce, P.L.C.

(57) ABSTRACT

A plurality of supporting rollers over which the endless belt member is supported includes at least a driving roller that drives the endless belt member and a driven roller that is driven by a rotation of the endless belt member. A detecting unit detects a plurality of marks provided on the driven roller at a predetermined position. A control unit controls a speed at which a driving unit drives the endless belt member based on a result of detecting the marks. The driven roller functions as a tension roller that applies a tension to the endless belt member. The detecting unit is held by the tension roller.

22 Claims, 13 Drawing Sheets

BELT DRIVING DEVICE AND IMAGE FORMING APPARATUS

CROSS-REFERENCE TO RELATED APPLICATIONS

The present application claims priority to and incorporates by reference the entire contents of Japanese priority document, 2007-002395 filed in Japan on Jan. 10, 2007.

BACKGROUND OF THE INVENTION

1. Field of the Invention

The present invention relates to a belt driving device and an image forming apparatus.

2. Description of the Related Art

A typical image forming apparatus, such as a multifunction product (MFP), a copier, a facsimile machine, and a printer, transfers an image formed on a latent-image carrier such as a photosensitive element to an intermediate transfer belt (primary transfer), and then transfers the image on the intermediate transfer belt to a recording medium (secondary transfer). In an image forming apparatus of a different type, an image formed on a latent-image carrier such as a photosensitive element is directly transferred to a recording medium held on a surface of a sheet-transfer belt. In the above image forming apparatuses, the image may be distorted if rotation speeds of the belts vary.

Japanese Patent Application Laid-open No. 2005-37620 discloses an image forming apparatus to prevent the image distortion due to the variation in the speed of the intermediate transfer belt. The image forming apparatus includes a plurality of rollers over which an intermediate transfer belt is supported (hereinafter, "supporting roller"). One of the supporting rollers serves as a driven roller that is driven by the rotation of the intermediate transfer belt, and the driven roller includes a circular detecting disk that is fixed to a rotation shaft of the driven roller. The detecting disk has a plurality of slits as marks and the slits revolve around the rotation shaft along with the rotation of the driven roller. A photosensor is provided near the driven roller, which serves as a mark detecting unit and detects each slot at a predetermined position. Time intervals between detections of the slits by the photosensor indicate the rotation speed of the intermediate transfer belt. By adjusting a driving speed of a driving motor serving as a driving source that drives the intermediate transfer belt based on a result of the detection by the photosensor, the rotation speed of the intermediate transfer belt can be kept stable.

One of the image forming apparatuses currently in use is configured to recognize a serial number, a property, and a size of each member for recognizing the end of a life of each member of the image forming apparatus and obtaining an excellent result by changing operation conditions based on variations in the property and the size per lot. For example, Japanese Patent Application Laid-open No. 2005-189599 discloses an image forming apparatus configured to read a barcode that is provided to a fixing belt of a fixing unit and that represents a serial number of the fixing belt, using a dedicated sensor for reading the barcode along with the rotation of the fixing belt. The number of rotations of the fixing belt is counted up until the result of reading the serial number changes, i.e., until the fixing belt is replaced, and when the result of the counting reaches the number representing the lifecycle of the fixing belt, the image forming apparatus recognizes that the life of the fixing belt is over. With this configuration, the image forming apparatus can automatically determine whether the life of the fixing belt is over; and therefore, it is unnecessary for a user to do a time-consuming operation for inputting information on the replacement of the fixing belt. As described above, because the image forming apparatus reads a serial number, for example, in a barcode that is different on a lot basis of a member, the end of the life of the member can be automatically recognized by the image forming apparatus.

Instead of the serial number, information on the property and the size of the product, which varies on a lot basis can be provided in the barcode. By changing operation conditions based on a result of reading the barcode, a better operation result can be obtained. A diameter of the driving roller that drives a belt member, which is an endless belt, can be slightly different on a product basis, which leads to a difference in the rotation speed on a product basis. By adjusting the rotation speed of the driving roller based on a result of reading a barcode representing the rotation speed of the belt member, it is possible to suppress variations in the rotation speed of the belt caused from the variation in the diameter of the driving roller. Moreover, although an electric resistance of each intermediate transfer belt of each image forming apparatus can be slightly different on a product basis, it is possible to suppress a variation in the electric resistance by adjusting a transfer bias based on the result of reading the electric resistance, thereby preventing an erroneous image transfer.

Regarding the image forming apparatus disclosed in Japanese Patent Laid-open No. 2005-37620, the supporting roller to which the marks (detecting disk) can be provided is limited to a specific type, which decreases a degree of freedom in layout. Specifically, at least one of the supporting rollers needs to be the driving roller that drives the belt member. The rotation speed of the driving roller does not accurately reflect the rotation speed of the belt member because a load is sometimes applied to the belt member and the belt member may slip on a surface of the driving roller. Therefore, it is desirable that the marks for detecting the speed be provided to the driven roller instead of the driving roller. However, some types of driven rollers, such as a tension roller that applies a tension to a belt member by a biasing member such as a spring, are not suitable for providing the marks. This is because the tension roller slightly moves when a force from the belt member rotating is applied to the tension roller, which leads to a variation in relative positions of the photosensor and the marks, and accordingly, it becomes difficult to accurately detecting the marks. As described above, because supporting rollers to which the marks can be provided for the speed detection are limited to the driven rollers other than the tension rollers, the degree of freedom in layout decreases.

Meanwhile, the image forming apparatus disclosed in Japanese Patent Application Laid-open No. 2005-189599 includes a dedicated sensor for reading a barcode, which increases the cost.

SUMMARY OF THE INVENTION

It is an object of the present invention to at least partially solve the problems in the conventional technology.

A device for driving a belt, according to one aspect of the present invention, includes an endless belt member; a plurality of supporting rollers over which the endless belt member is supported, which include at least a driving roller that drives the endless belt member and a driven roller that is driven by a rotation of the endless belt member; a driving unit that drives the driving roller; a plurality of marks provided on the driven roller; a detecting unit that detects the marks on the driven roller at a predetermined position; and a control unit that controls a speed at which the driving unit drives the endless belt member based on a result of detecting the marks by the detecting unit. The driven roller functions as a tension roller that applies a tension to the endless belt member. The detecting unit is held by the tension roller.

An image forming apparatus according to another aspect of the present invention includes a belt driving device including an endless belt member, a plurality of supporting rollers over which the endless belt member is supported, which include at least a driving roller that drives the endless belt member and a driven roller that is driven by a rotation of the endless belt member, a driving unit that drives the driving roller, a plurality of marks provided on the driven roller, a detecting unit that detects the marks on the driven roller at a predetermined position, and a control unit that controls a speed at which the driving unit drives the endless belt member based on a result of detecting the marks by the detecting unit, where the driven roller functions as a tension roller that applies a tension to the endless belt member, and the detecting unit is held by the tension roller; an image carrier that carries an electrostatic latent image; a developing unit that develops the electrostatic latent image on the image carrier to obtain a visible image; and a transferring unit that transfers the visible image on the image carrier directly to a recording medium that is held on a surface of the endless belt member, or transfers the visible image on the image carrier to the endless belt member and transfers the visible image on the endless belt member to the recording medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
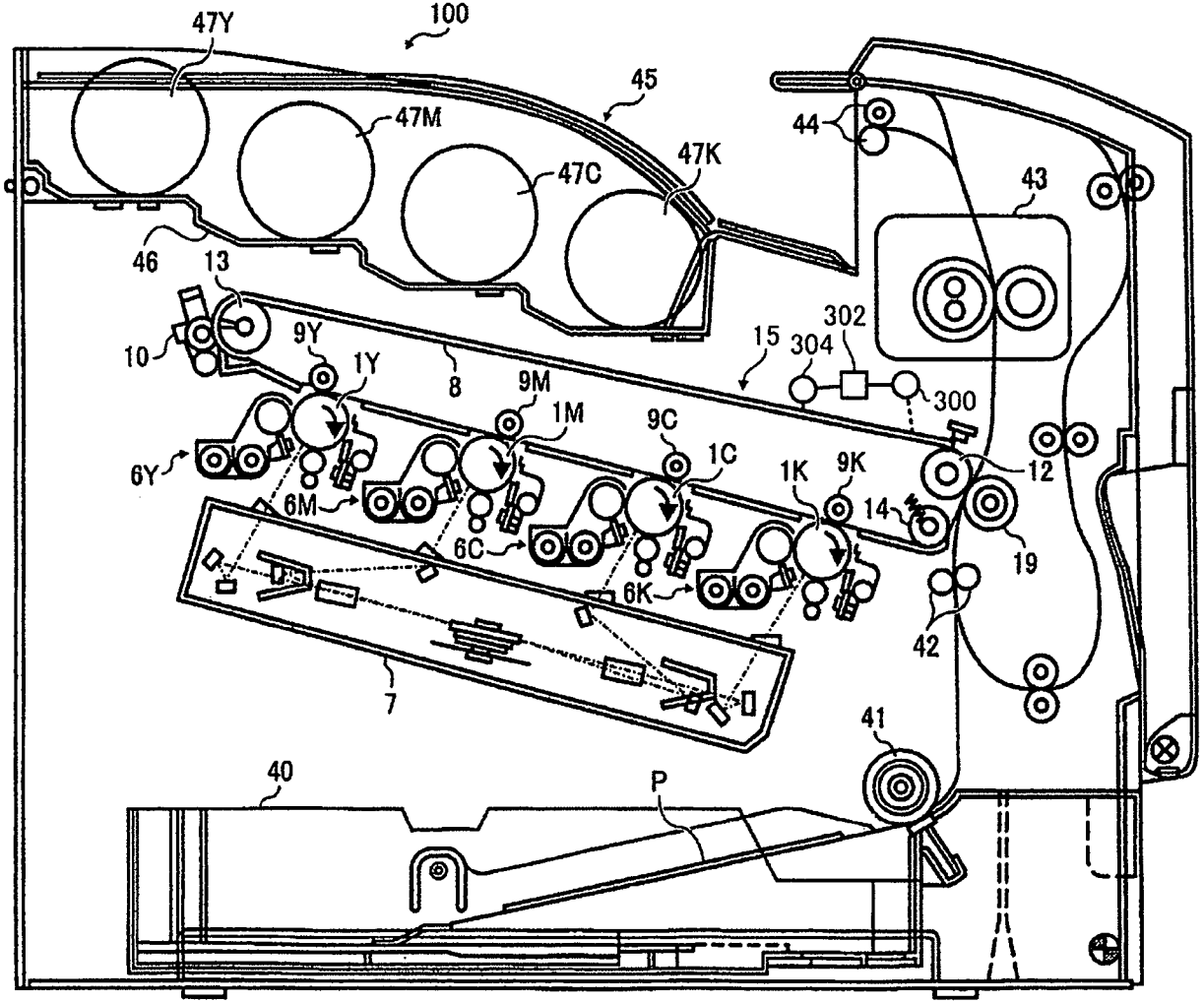
FIG. 1 is a schematic diagram of a printer according to an embodiment of the present invention.

FIG. 1 is a schematic diagram of a printer 100 according to an embodiment of the present invention. The printer 100 includes four processing units 6Y, 6M, 6C, and 6K that generate toner images for yellow (Y), magenta (M), cyan (C), and black (K). The processing units 6Y to 6K have the same configuration except that different toners of Y, M, C, and K toners are employed for the respective processing units 6Y to 6K as image forming materials. Each of the processing units 6Y to 6K is replaced when the life of each processing unit is over. For example, the processing unit 6Y includes a photosensitive element 1Y that is cylindrical, a drum cleaning unit 2Y, a neutralizing unit (not shown), a charging unit 4Y, and a developing unit 5Y. The processing unit 6Y is detachably attached to the printer 100 and is replaced on a unit basis.

The charging unit 4Y electrically and uniformly charges a surface of the photosensitive element 1Y that is rotated clockwise by a drive unit (not shown). The surface of the photosensitive element 1Y is scanned by a laser light L emitted from a scanning unit 7 so that an electrostatic latent image is formed on the surface of the photosensitive element 1Y. The electrostatic latent image on the photosensitive element 1Y is developed by the developing unit 5Y as a Y toner image, using the Y toner, and the Y toner image is transferred onto an intermediate transfer belt 8 serving as an intermediate transfer medium.

Thereafter, the drum cleaning unit 2Y removes the Y toner residing on the photosensitive element 1Y, and the neutralizing unit removes residual electric charges on the photosensitive element 1Y. As a result, the surface of the photosensitive element 1Y can be ready for the next image formation. Similarly, M, C, and K toner images are formed on surfaces of photosensitive elements 1M, 1C, and 1K, and the Y, M, C, and K toner images are sequentially transferred onto the surface of the intermediate transfer belt 8 so that an overlapped four-color toner image of the Y, M, C, and K toner images is formed.

As shown in FIG. 1, the scanning unit 7 serving as an electrostatic-latent-image forming unit is provided below the processing units 6Y, 6M, 6C, and 6K. The scanning unit scans the surfaces of the photosensitive elements 1Y, 1M, 1C, and 1K each serving as an image carrier with the laser light L emitted based on image information, so that electrostatic latent images for Y, M, C, and K are formed on the photosensitive elements 1Y, 1M, 1C, and 1K. The scanning unit 7 scans the photosensitive elements 1Y, 1M, 1C, and 1K with the laser light L in a way that the laser light L is reflected on a polygon mirror, which is rotated by a driving unit, and the laser light L is applied to the photosensitive elements 1Y, 1M, 1C, and 1K via a plurality of optical lenses and mirrors.

A sheet feeding unit is provided below the scanning unit 7. The sheet feeding unit includes a sheet cassette 40, a sheet feeding roller 41, and a pair of registration rollers 42. The sheet cassette 40 stores therein a plurality of stacked paper sheets P serving as recording medium and the top paper sheet is in contact with the sheet feeding roller 41. Along with the rotation of the sheet feeding roller 41 counter-clockwise by a drive unit (not shown), the top paper sheet P is fed and interposed between the registration rollers 42. The registration rollers 42 are rotated such that the paper sheet P is interposed in between, and are stopped immediately after the tip portion of the paper sheet P is interposed. Thereafter, the paper sheet P is conveyed to a nip, at which the image on the intermediate transfer belt 8 is transferred to the paper sheet P (secondary transfer), at an appropriate timing.

A transfer unit 15 is provided above the processing units 6Y, 6M, 6C, and 6K. The transfer unit 15 includes the intermediate transfer belt 8 that serves as a belt member and that moves while being supported over the transfer unit 15. The transfer unit 15 further includes four primary-transfer rollers 9Y, 9M, 9C, and 9K, a belt cleaning unit 10, a secondary-transfer roller 19, and a driving unit (not shown) that drives the secondary-transfer roller 19. The transfer unit 15 further includes a driving roller 12, a cleaning backup roller 13, and the tension roller 14 that serve as supporting rollers over which the intermediate transfer belt 8 are supported, and the intermediate transfer belt 8 rotates anti-clockwise in FIG. 1 along with the rotation of the driving roller 12.

While a primary-transfer bias from a bias-applying unit (not shown) is applied to the primary-transfer rollers 9Y, 9M, 9C, and 9K, the intermediate transfer belt 8 is interposed between the primary-transfer rollers 9Y, 9M, 9C, and 9K and the photosensitive elements 1Y, 1M, 1C, and 1K. Therefore, primary transfer nips for Y, M, C, and K are formed between the outer surface of the intermediate transfer belt 8 and the photosensitive elements 1Y, 1M, 1C, and 1K. The rollers other than the primary-transfer rollers 9Y, 9M, 9C, and 9K are electrically grounded.

While the intermediate transfer belt 8 rotates and passes through the primary transfer nips for Y, M, C, and K, the Y, M, C, and K toner images are transferred to the intermediate transfer belt 8 (primary transfer) so that the overlapped four-color toner image is formed on the intermediate transfer belt 8.

Because the intermediate transfer belt 8 is interposed between the driving roller 12 and the secondary-transfer roller 19 provided outside a loop of the intermediate transfer belt 8, a secondary-transfer nip is formed between the outer surfaces of the intermediate transfer belt 8 and the secondary-transfer roller 19.

The registration rollers 42 provided below the secondary-transfer nip conveys the paper sheet P at a predetermined timing such that the overlapped four-color toner image on the intermediate transfer belt 8 can be transferred onto the paper sheet P. As a result, the overlapped four-toner image on the intermediate transfer belt 8 is closely in contact with the paper sheet P at the secondary-transfer nip. The secondary-transfer roller 19 to which the secondary transfer bias is applied, a secondary transfer electric field, and a pressure at the secondary-transfer nip cause the overlapped four-toner image to be transferred onto the paper sheet P.

The toner resides on the intermediate transfer belt 8 even after the intermediate transfer belt passes through the secondary-transfer nip. The belt cleaning unit 10 cleans the toner.

A belt driving device includes the intermediate transfer belt 8, the driving roller 12, the cleaning backup roller 13, the tension roller 14, the driving unit 300 that drives the driving roller, and a control unit 302 that controls the driving unit 300 of the transfer unit 15.

The overlapped four-color toner image on the paper sheet P is conveyed from the secondary-transfer nip and is fixed by heat and pressure when the paper sheet P passes through rollers of a fixing unit 43,. Thereafter, the paper sheet P passes through a pair of sheet discharging rollers 44 and is discharged to the outside of the printer 100. The paper sheet P is stacked on a stacking unit 45 formed on a top surface of the printer 100.

Figure 2:
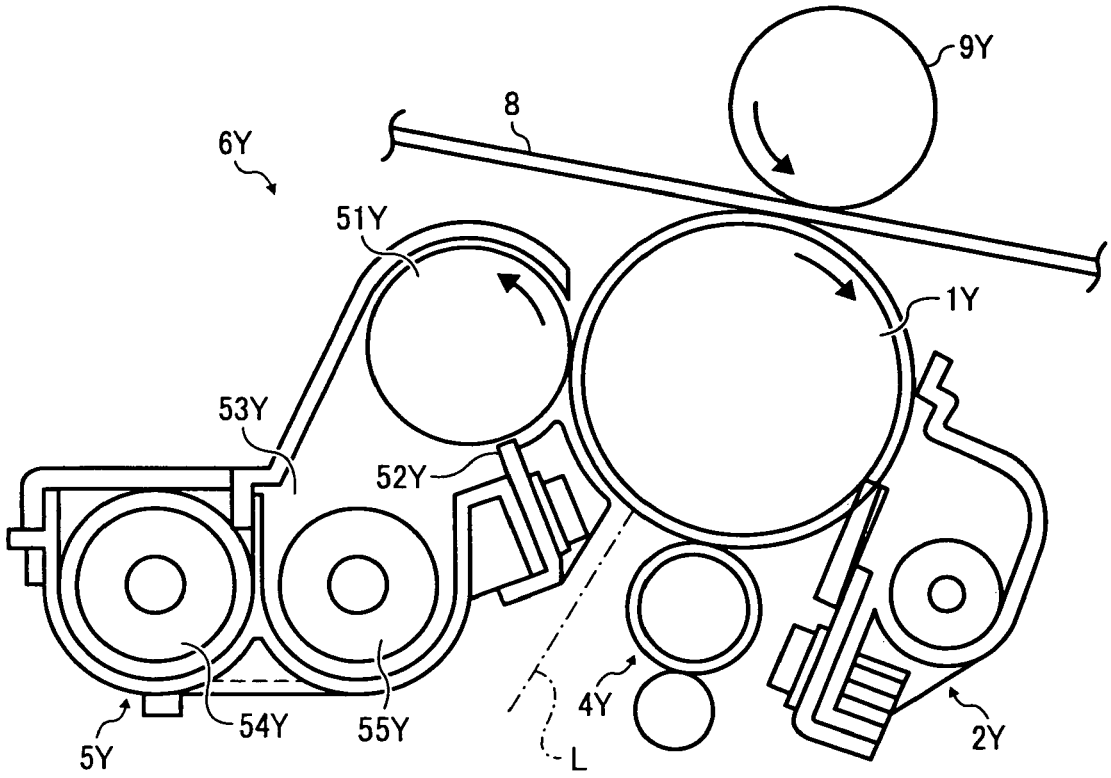
FIG. 2 is an enlarged schematic diagram of a belt unit of a transfer unit shown in FIG. 1.

The developing unit 5Y shown in FIG. 2 includes a developing sleeve 51Y that is rotated anti-clockwise by a driving unit (not shown) and a magnetic roller (not shown) that is provided in the developing sleeve 51Y and that is not moved along with the rotation of the developing sleeve 51Y. The developing sleeve 51Y is cylindrical and made of a non-magnetic material. The developing unit 5Y further includes a doctor blade 52Y, a developer containing unit 53Y that contains a developer (toner) made of two components (i.e., a magnetic carrier and a toner), and a first transfer screw 54Y and a second transfer screw 55Y that are provided in the developer containing unit 53Y.

The developer containing unit 53Y is divided into a first storing unit and a second storing unit. The first transfer screw 54Y is provided in the first storing unit, and the second transfer screw 55Y is provided in the second storing unit. The first storing unit and the second storing unit communicate with each other on both end portions of the developer containing unit 53Y in a direction orthogonal to the rotation axis of a developing sleeve 53, because a shielding for separating the first storing unit and the second storing unit is not provided on the end portions. The developer transferred to one of the end portions with the rotation of the first transfer screw 54Y flows into the second housing unit. The developer is then transferred to the other end portion of the second housing along with the rotation of the second transfer screw 55Y, and flows back into the first storing unit. In this manner, the developer in the developer containing unit 53Y is circulated in the first storing unit and the second storing unit while being transferred. The Y toner is electrically charged by friction while being the circulated and transferred.

The developing sleeve 51Y that is rotated above the second storing unit lifts up the developer in the second storing unit along the inner surface of the second storing unit by a magnetic force from the magnetic roller. Thereafter, a thickness of the developer is regulated when passing through a position, which is opposed to the doctor blade, with the rotation of the developing sleeve 51Y. After the developer is conveyed to a developing area opposed to the photosensitive element 1Y, the Y toner is adhered onto the electrostatic latent image formed on the photosensitive element 1Y. Thereafter, the developer flows back to the position opposed to the second storing unit with the rotation of the developing sleeve 51Y. Because of the influence of the opposite magnetic field generated by the magnetic roller, the developer separates from the surface of the developing sleeve 51Y and falls into the second storing unit.

A toner concentration sensor (not shown) such as a permeability sensor is fixed to a bottom surface of the second storing unit. The toner concentration sensor detects the concentration of the developer conveyed through the second storing unit. Because the result of the detection is sent to a Y-toner supplying unit (not shown), the Y toner is appropriately supplied to the second storing unit so that the toner concentration of the developer can be in a predetermined range. Similarly, toner concentrations of developers are controlled in developing units for other colors of M, C, and K.

As shows in FIG. 1, a bottle housing unit 46 is provided between the transfer unit 15 and the stacking unit. 45 above the transfer unit 15. The bottle housing unit 46 houses toner bottles 47Y, 47M, 47C, and 47K that stores therein the Y, M, C, K toners. The Y, M, C, and K toners stored in the toner bottles 47Y to 47K are appropriately supplied to the developing devices of the respective processing units 6Y to 6K by the Y-toner supplying unit, and M-toner, C-toner, and K-toner supplying units (not shown). The tonner bottles 47Y, to 47K are independent of the processing units 6Y to 6K and detachably attached to the printer 100.

Figure 3:
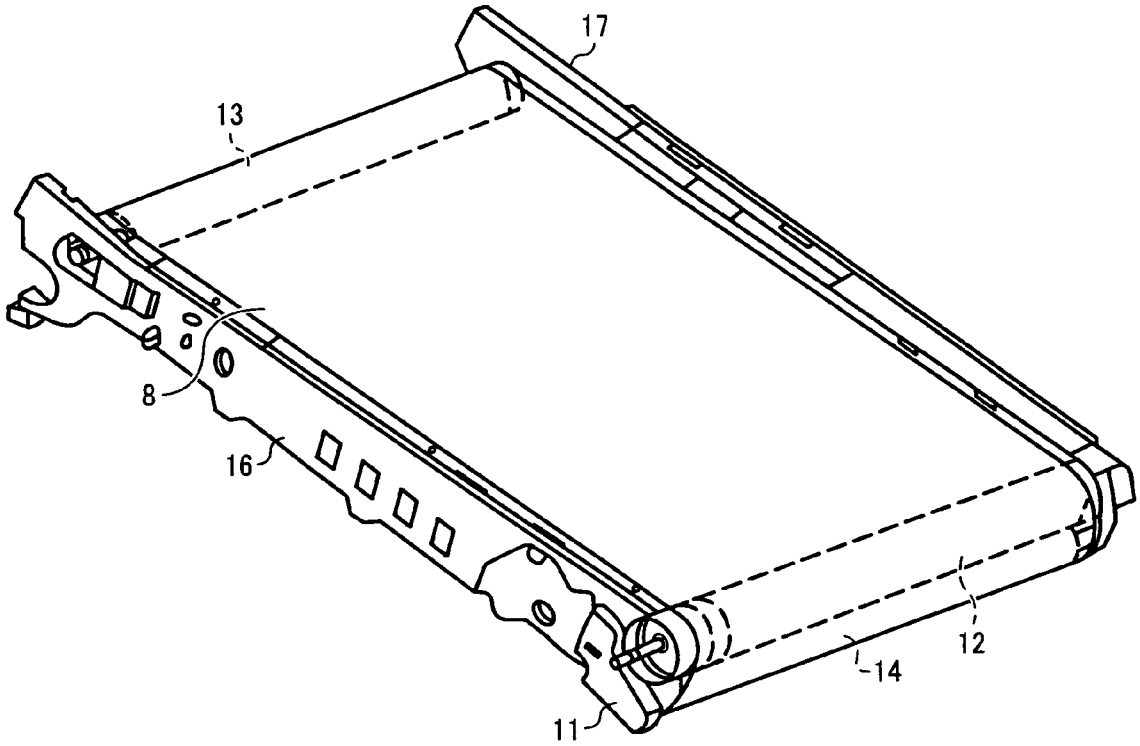
FIG. 3 is a perspective view of the belt unit of the transfer unit.

FIG. 3 is a perspective view of a belt unit of the transfer unit 15. The belt unit constitutes a part of the belt driving device of the transfer unit 15, and is detachable from the printer 100 by sliding. A unit front plate 16 rotatably supports ends of the driving roller 12, the cleaning backup roller 13, and the tension roller 14 on one side in the direction of the rotation axes of the driving roller 12, the cleaning backup roller 13, and the tension roller 14, and a unit back plate 17 rotatably supports ends of the rollers on the other side. In other words, the driving roller 12, the cleaning backup roller 13, and the tension roller 14 are bridged between the unit front plate 16 and the unit back plate 17. The primary-transfer rollers 9Y, 9M, 9C, and 9K are not shown in FIG. 3.

Figure 4:
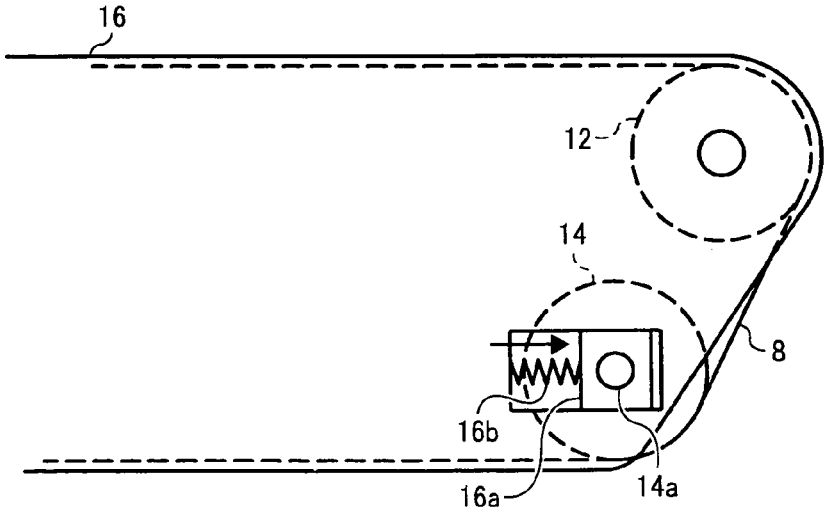
FIG. 4 is a schematic diagram of a part of a unit font plat of the belt unit.

FIG. 4 is a schematic diagram of a part of the unit front plate 16. A tension roller bearing 16*a* slidably engages with the unit front plate 16, and the tension roller bearing 16*a* is biased by a spring 16*b* in the direction indicated by the arrow shown in FIG. 4. The tension roller 14 includes a roller member 14*a*, and rotation shafts 14*b* each protruding from each end of the roller member 14*a* in the axial direction of the roller member 14*a*. The tension roller bearing 16*a* is also provided to the unit back plate 17 opposed to the unit front plate 16 with a certain distance in between. As described above, the tension roller 14 is slidably supported by the unit front plate 16 and the unit back plate 17 via the tension roller bearings 16*a*. Because one of the ends of each of the rotation shafts 14*b* is biased by the springs 16*b* via the tension roller bearings 16*a*, a tension is applied to the intermediate transfer belt 8. Although a sliding bearing is used as the tension roller bearing 16*a* according to the embodiment, a roller bearing can be alternatively used.

Figure 5:
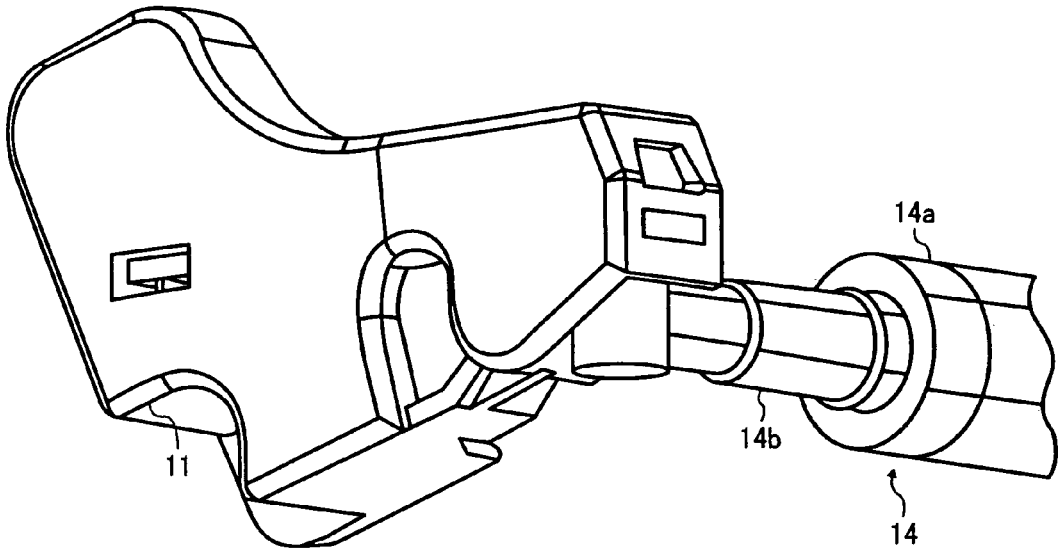
FIG. 5 is an enlarged perspective view of an end portion of a tension roller of the belt unit and a cover member covering the end portion.

FIG. 5 is an enlarged perspective view of the end portion of the tension roller 14 and a cover member 11 that covers the end portion. The rotation shaft 14*b* of the tension roller 14 is rotatably supported by the tension roller bearing 16*a*. The cover member 11 covers a tip portion of the rotation shaft 14*b*. Metal rollers made of, for example, stainless or iron are employed for the roller member 14*a*, and the rotation shafts 14*b* according to the embodiment. A variation in diameter of the metal roller, which is caused due to a temperature change, is small compared with that of a roller made of resin.

Figure 6A:
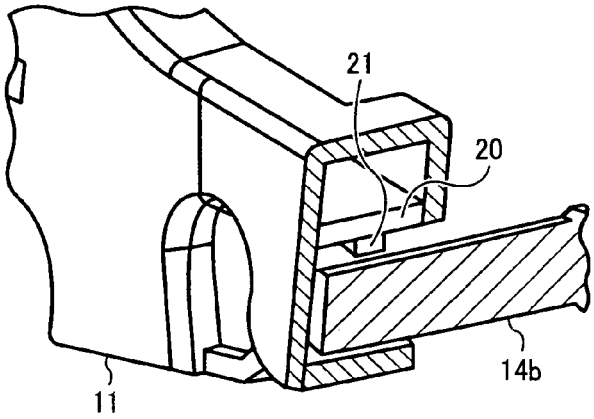
FIGS. 6A and 6B are a perspective cross section and a cross section of a tip portion of a rotation shaft and the cover member that covers the tip portion.
Figure 6B:
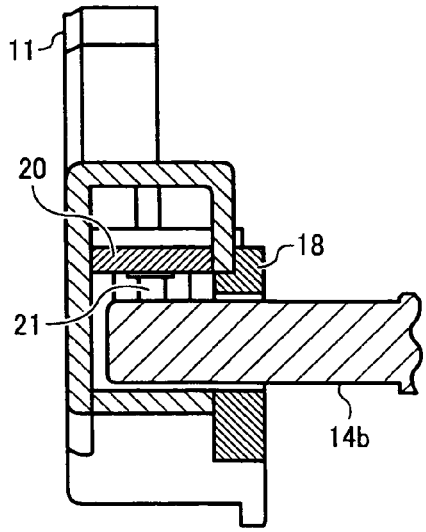

FIGS. 6A and 6B are a perspective cross section and a cross section of the tip portion of the rotation shaft 14*b* and the cover member 11. The cover member 11 includes a shaft bearing 18 through which the tip portion of the rotation shaft 14*b* penetrates. The shaft bearing 18 is not for supporting the tension roller 14, but for causing the rotation shaft 14*b* to support the cover member 11.

In addition to the tip portion of the rotation shaft 14*b*, a sensor holder 20 and an optical sensor 21 that is supported by the sensor holder 20 are housed in the cover member 11. The optical sensor 21 serving as a mark detecting unit is opposed to an inner surface of the tip portion of the rotation shaft 14*b* with a predetermined distance in between.

The optical sensor 21 includes a luminous element (not shown) a light receptor (not shown). A luminous element outputs a light to the inner surface of the tip portion of the rotation shaft 14*b* that reflects the light. The light receptor receives the reflected light, and outputs a voltage corresponding to the amount of the light to the control unit. The control unit that controls the printer 100 includes a central processing unit (CPU) serving as a computer, a read only memory (ROM) serving as an information storing unit, an I/O unit, and analog/digital (A/D) converter. The control unit sends a control signal to each unit and performs an operation based on a control program stored in the RAM or the ROM.

Figure 7:
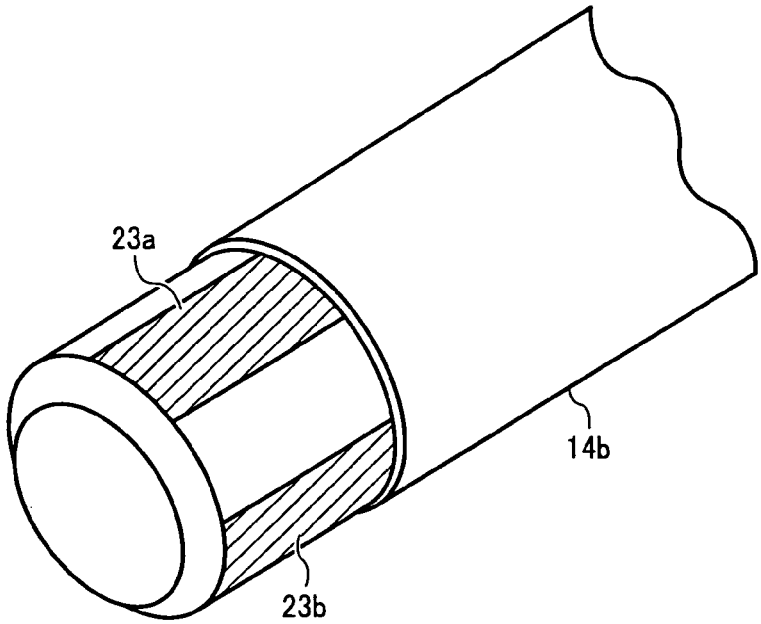
FIG. 7 is an enlarged perspective view of the tip portion of the rotation shaft.

FIG. 7 is an enlarged perspective view of the tip portion of the rotation shaft 14*b* of the tension roller 14. A mark pattern including a first to a fourth marks 23*a*, 23*b*, 23*c*, 23*d* formed along the direction in which the rotation shaft 14*b* rotates (hereinafter, "shaft rotation direction"), i.e., the direction in which the tension roller 14 rotates, is formed on the outer surface of the tip portion of the rotation shaft 14*b*. The first to the fourth marks 23*a* to 23*d* are colored in, for example, black that has a low reflectivity. On the other hand, the portions between the marks are colored in, for example, silver that has a high reflectivity. When one of the first to the fourth marks 23*a* to 23*d* is opposed to the optical sensor 21 with the rotation of the rotation shaft 14*b* and the light is applied by the light emitting element to the mark, most of the light is absorbed by the mark. Therefore, the light receptor of the optical sensor 21 receives a small amount of the light. On the other hand, when the portion between the marks is opposed to the optical sensor 21 with the rotation of the rotation shaft 14*b* and the light is applied by the light emitting element to the portion, most of the light is reflected on the portion. Therefore, the light receptor receives a large amount of the light. Based on a variation in a voltage that is output from the optical sensor 21 and that corresponds to the amount of the received light, the control unit detects the first to the fourth marks 23*a* to 23*d*. Because the tension roller 14 is the driven roller that is driven by the rotation of the intermediate transfer belt 8, a rotation speed of the tension roller 14 reflects the rotation speed of the intermediate transfer belt 8. Therefore, the control unit can recognize the rotation speed of the intermediate transfer belt 8 based on each time interval between detections of the marks (hereinafter, "detection time interval").

As shown in FIG. 4, the tension roller 14 is rotatably supported by the tension roller bearings 16*a*. The cover member 11 moves along with the tension roller 14. Because the optical sensor 21 is supported by the tension roller 14, the optical sensor 21 is moved along with the tension roller 14. Therefore, even if the tension roller 14 is moved due to a force from the intermediate transfer belt 8, relative positions of the first to the fourth marks 23*a* to 23*d* and the optical sensor 21 can be kept the same. The above-explained structure increase a degree of freedom in designing the tension roller 14 on which the marks are formed. Moreover, because the first to the fourth marks 23*a* to 23*d* are accurately detected by the optical sensor 21, the rotation speed of the intermediate transfer belt 8 can be kept stable.

Figure 8:
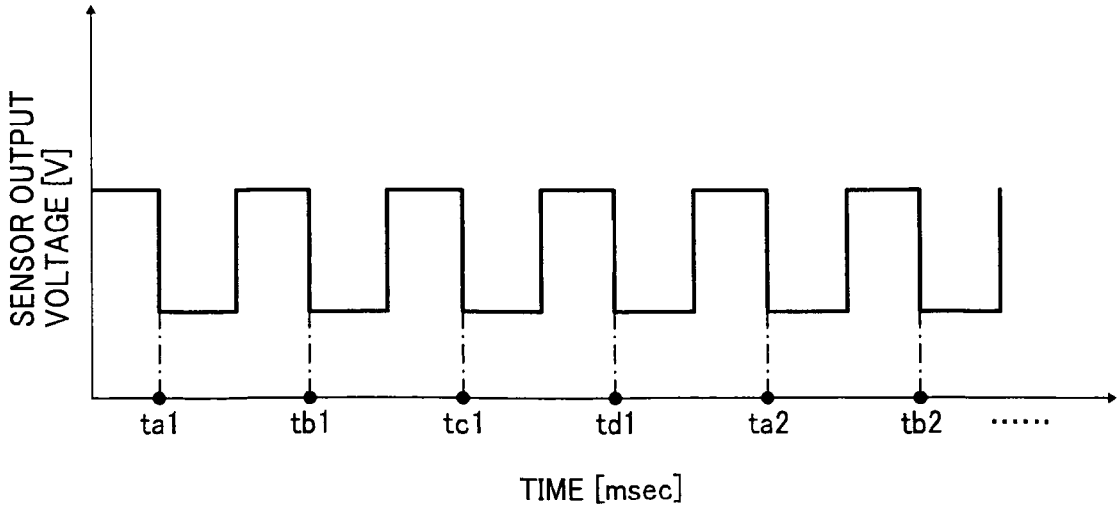
FIG. 8 is a graph of voltages output from an optical sensor of the printer.

As shown in FIG. 7, the first to the fourth marks 23*a* to 23*d* have the same length and are formed at the same pitches in the rotation direction of the rotation shaft 14*b*. When the tension roller 14 rotates at a constant speed, the marks are detected at constant detection time intervals as shown in FIG. 8. Because the detection time intervals has a relation with the rotation speed of the tension roller 14 (the rotation speed of the intermediate transfer belt 8), the control unit 302 can recognize the rotation speed of the intermediate transfer belt 8 based on the detection time intervals. When the detection time interval is out of a predetermined range, the control unit 302 changes the driving speed of a driving motor of the driving unit 300 that drives the driving roller 12. In this manner, the intermediate transfer belt 8 rotates stably at a constant speed.

At the timings ta1, tb1, tc1, and td1 shown in FIG. 8, the first to the fourth marks 23*a* to 23*d* are detected respectively. As shown in FIG. 8, the voltage that is output from the optical sensor 21 is lower when any mark is not detected, because the reflectivity of the first to the fourth marks 23*a* to 23*d* are lower than those of the portions between the marks.

The rotation speed of the intermediate transfer belt 8 can be calculated not based on the detection time interval between each detection, but based on a time from a detection of a mark for the first time (hereinafter, "first detection") to a detection of the mark for the second time (hereinafter, "second detection"). Specifically, the time required for one rotation of the rotation shaft 14*b* is equivalent to a time from a first detection to a second detection of each mark. Based on the time, the rotation speed of the intermediate transfer belt 8 can be calculated.

Although the first to the fourth marks 23*a* to 23*d* are made of a material having a low reflectance and the portions between the marks are made of a material having a high reflectance, the marks can be made of a material having a high reflectance and the portions between the marks can be made of a material having a low reflectance.

Figure 9:
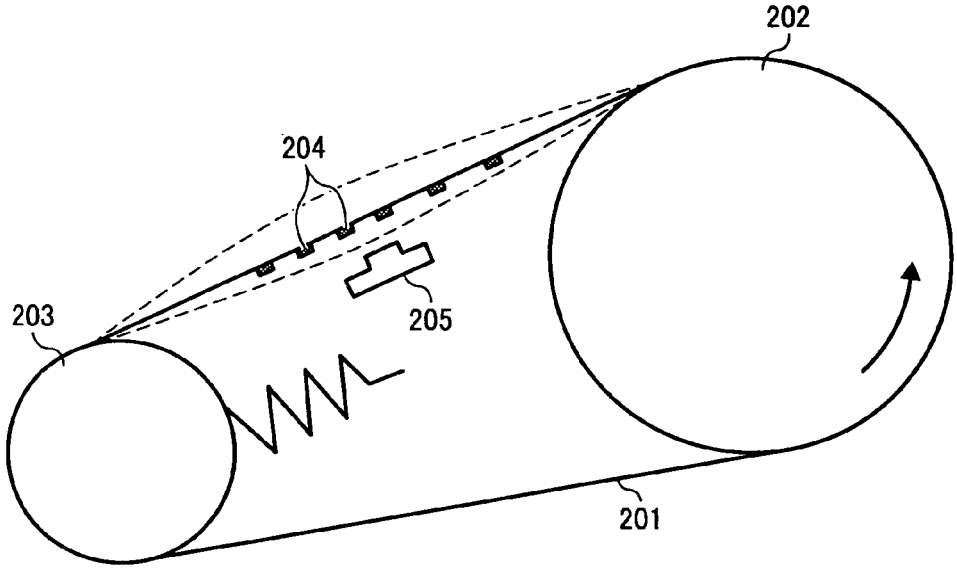
FIG. 9 is a schematic diagram of a conventional transfer unit that includes a belt member having marks to be detected by an optical sensor to calculate rotation speed of the belt member.
Figure 10:
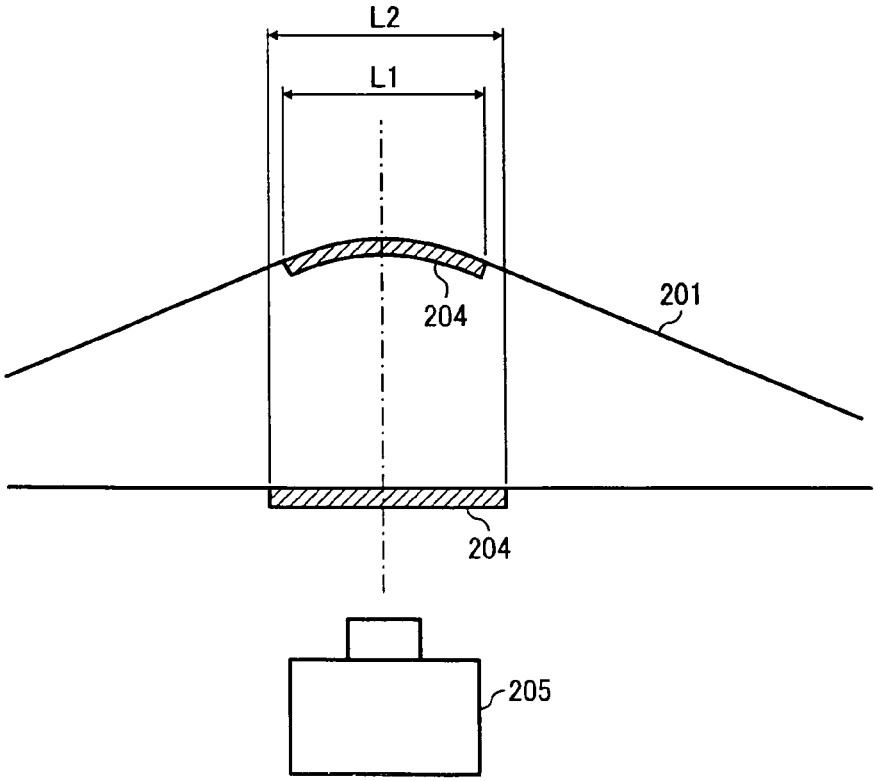
FIG. 10 is a schematic diagram of the belt member shown in FIG. 9 for explaining a relation between a not-tensioned part of the belt member and variations in lengths of the marks detected by the optical sensor.

As a method of detecting the rotation speed of the intermediate transfer belt 8, a method of detecting marks formed on the intermediate transfer belt 8 can be adopted instead of the method of detecting marks formed on the tension roller 14 (driven member). If the method of detecting the marks on the intermediate transfer belt 8 is adopted for the printer 100, however, downsizing of the transfer unit 15 is difficult because of the following reasons. As shown in FIG. 9 that is a schematic diagram of a conventional transfer unit, a belt member 201 that is an endless belt member is moved anticlockwise while being supported across a driving roller 202 and a tension roller 203. For downsizing, a plurality of marks 204 should preferably be provided to an inner surface of the belt member 201 as shown in FIG. 10. In this case, an optical sensor 205 is provided in a loop of the belt member 201, which results in downsizing of the transfer unit. However, as shown in FIG. 10, the marks 204 on a part of the belt member 201 that is not fully tensioned as shown by a dotted line shown in FIG. 9 and that is supported across the tension roller 203 and the driving roller 202 are detected by the optical sensor 205. As a result, a variation in the distance between the optical sensor 205 and the belt member 201, which is caused because the belt member 201 is not fully supported, changes a result of the detection of the length of the mark 204 in the direction in which the belt member 201 moves changes. Accordingly, an error occurs in detecting the rotation speed of the belt member 201. For preventing such an error, a pressurizing roller can be provided to the outside of the loop of the belt member 201 to detect the marks 204 at a position on the inner surface of the belt member 201 where the pressurizing roller is strongly pressed against the outer surface of the belt member 201. However, the provision of the pressurizing roller outside the loop of the belt member 201 makes the downsizing of the transfer unit difficult. In addition, a structure can be alternatively adopted in which the marks 204 are provided to the outer surface of the belt member 201 and are detected at a position on the driving roller 202, or the tension roller 203, on which the belt member 201 is tensioned. However, the optical sensor 205 needs to be provided to the outside of the loop of the belt member 201, and this makes the downsizing of the transfer unit difficult. On the other hand, in the method of detecting the marks on the tension roller 14 according to the embodiment, the rotation speed of the belt member can be detected without an error resulting from a not-tensioned part of a belt member.

Examples 1 to 7 of the printer 100 according to the embodiment are explained below. As long as not particularly mentioned, structures and the configurations of printers of Examples 1 to 7 are same as that of the printer 100.

A printer according to Example 1 employs the following mark pattern as a plurality of marks formed on the rotation shaft 14*b* of the tension roller 14. Pitches between the marks, or the lengths of the marks in the shaft rotation direction on a tip portion of the rotation shaft 14*b* are not uniform in the mark pattern representing information. Based on a result of detecting the marks, the rotation speed of the intermediate transfer belt 8 is recognized and information represented by the mark patterns can be determined.

There are various kinds of mark patterns as mark patterns for obtaining specific information while obtaining the rotation speed of a belt member. As a first example of the mark pattern of Example 1, tops of marks in the shaft rotation direction are positioned at uniform pitches, and bottoms of the marks in the shaft rotation direction are positioned at different pitches because each mark has a different length shaft rotation direction. Based on detection time intervals between detections of the tops of the marks that are positioned in the uniform pitches, the rotation speed of the intermediate transfer belt 8 can be determined. Meanwhile, based on detection time intervals between detections of the bottoms of the marks that are positioned at the different intervals, certain information can be determined.

If the speed of the belt member varies (when the speed of the tension roller 14 serving as a secondary-transfer nip side roller varies), the result of the detection of the detection time intervals between the bottoms of the marks is different from the result that should be obtained with the original pattern. However, by calculating an average of the detection time intervals for a plurality of rotations of the belt member, an error in the detection can be avoided. For example, in the case where the ratio of the intervals between the bottoms of the marks is 1:5:12:8, the ratio of the detection time intervals of the detections of the bottoms is 1:5:12:8 as long as the belt member rotates at a constant speed, and the mark pattern is appropriately read. Even if the ratio slightly changes due to the variation in the rotation speed of the belt member, the original ratio can be calculated by obtaining an average of the ratio for a plurality of rotations of the belt member and by rounding down the average.

A mark pattern representing specific information according to a second example of Example 1 includes marks each having a bottom in the shaft rotation direction that has a length different from those of other marks so that the bottoms of the marks are positioned at different pitches. In the second example, the rotation speed of a belt member can be calculated based on, for example, time intervals between detections of the bottoms. In addition, specific information can be determined based on the ratio of the time intervals between the detections of the bottoms.

A mark pattern representing specific information according to a third example of Example 1 includes marks having the same lengths in the shaft rotation direction and positioned in different pitches. In the third example, the rotation speed of a belt member is calculated not based on the detection time intervals but based on each time required for detection of each mark per rotation. For example, in a case where four marks are formed on the circumference of the rotation shaft 14*b*, each mark is detected every time after the four marks are detected.

A mark pattern representing specific information of a fourth example of Example 1 includes marks each having a different length in the shaft rotation direction and positioned in different pitches. In the fourth example, the rotation speed of a belt member is calculated based on each time of detection of each mark per rotation as in the case of the third example.

In the printer 100 according to Example 1 employs the mark pattern of the fourth example because of the following reasons. In the case of the Example 1 where the marks are formed on the rotation shaft 14*b* of the tension roller 14, the number of marks that can be provided to the rotation shaft 14*b* are smaller than those in the case where the marks are provided to a belt-member, which limits the amount of information represented by the marks. Because the tops or the bottoms of the marks of the first or the second examples need to be positioned at uniform intervals, the amount of information represented by the marks is further limited. The amount of information is limited also in the third example because the length of the marks and the pitches between the marks are the same. Compared to the first to the third examples, the amount of information represented by the marks is large in the forth example because the length of the marks and the pitches between the marks are different from each other.

Even though it is required to calculate the rotation speed of the belt member based on the time required for one rotation of each mark in the fourth example as explained above, a variation in the rotation speed of the belt member can be promptly detected if the tension roller 14 has a relatively small diameter and thus the amount of one rotation of the belt member is relatively small.

Figure 11:
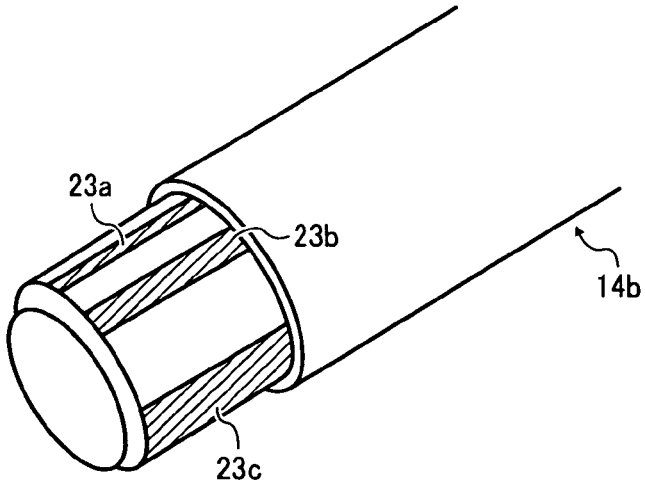
FIG. 11 is an enlarged perspective view of a tip portion of a rotation shaft of a printer according to Example 1.
Figure 12:
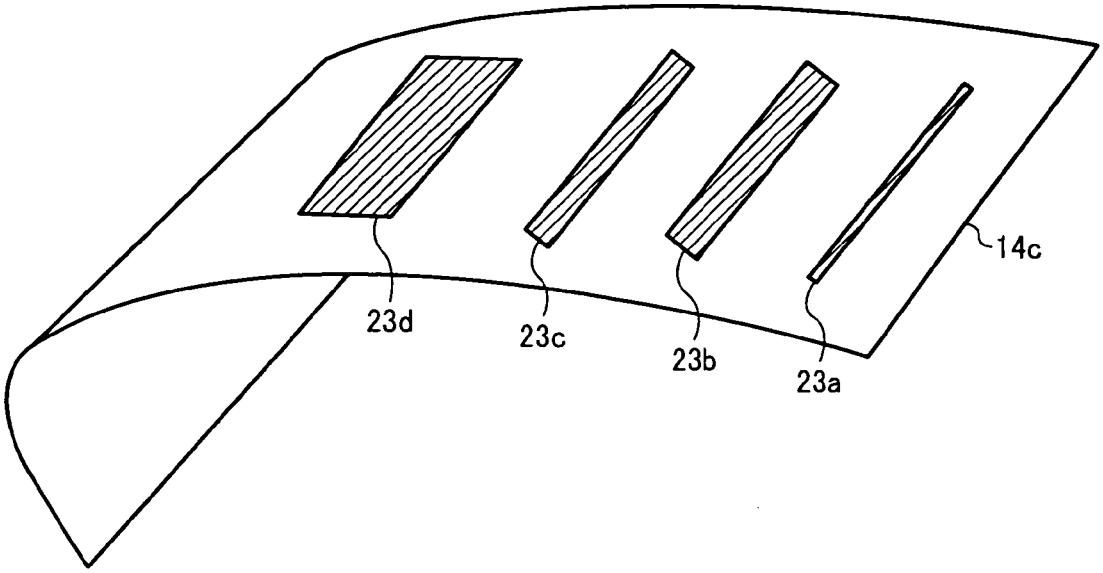
FIG. 12 is a perspective view of an adhesive tape of the printer according to Example 1 that has a mark pattern.

FIG. 11 is an enlarged perspective view of the tip portion of the rotation shaft 14*b*. The first to the fourth marks 23*a* to 23*d* have different lengths in the shaft rotation direction and are positioned in different pitches. The mark pattern can be formed by paint or by vapor deposition on the rotation shaft 14*b*. Alternatively, as shown in FIG. 12, an adhesive tape 14*c* on which a mark pattern is formed can be attached to the rotation shaft 14*b*.

Figure 13:
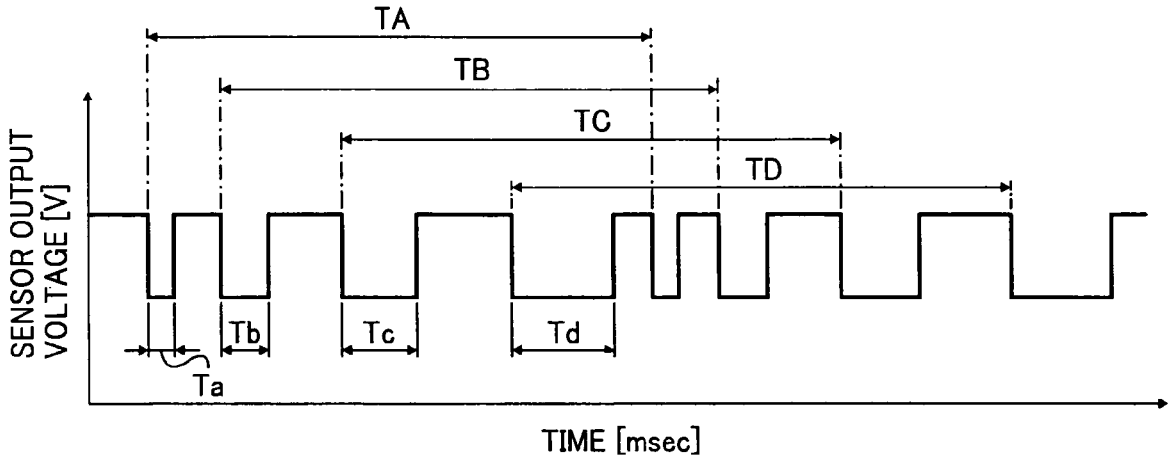
FIG. 13 is a graph representing a relation between time and voltage output from an optical sensor that detects the mark pattern according to Example 1.

FIG. 13 is a graph representing a relation between time and voltages output from the optical sensor 21 that detects the mark pattern. The first mark 23*a* has the smallest length and serves as a standard mark. The first mark 23*a* represents a position where reading of the mark pattern starts. The length of the first mark 23*a* is set to 2 millimeters and those of other marks are set to 3 millimeters or more.

Each of detection times Ta, Tb, Tc, and Td shown in FIG. 13 denotes a time during which a corresponding mark is detected by the optical sensor 21. After the control unit starts the driven rotation of the tension roller 14 along with the rotation of the intermediate transfer belt 8 (the driving rotation of the roller 12), the control unit specifies the first mark 23*a* among the marks based on the variation in the voltage output from the optical sensor 21. As shown in FIG. 13, the detection time Ta of the first mark is the shortest. Based on the detection time Ta, the control unit specifies the first mark 23*a*.

If the rotation speed of the intermediate transfer belt 8 varies while the tension roller 14 rotates once, the ratio of the detection times varies. However, the variation in the ratio is small as long as an occurrence of an error is not a variation in the rotation speed. Therefore, as long as the printer 100 operates in a normal state, the first mark 23*a* can be determined appropriately based on the ratio of the detection times even if a variation in the rotation speed of the intermediate transfer belt 8 occurs in a steady state.

After determining the first mark 23*a*, the control unit detects the top of the first mark 23*a* in the shaft rotation direction and starts counting a first-mark rotation time TA from firstly detecting the first mark 23*a* to secondarily detecting the first mark 23*a*, i.e., the time required for one rotation of the first mark 23*a*. In addition, the control unit sequentially starting counting a second-mark rotation time TB, a third-mark rotation time TC, and a fourth-mark rotation time TD. The control unit detects the variation in the rotation speed of the intermediate transfer belt 8 in real time by counting the first to the fourth rotation times TA, TB, TC, and TD, and performs feedback control, i.e., sends back a result of the detection to the driving unit of the transfer unit 15. The variation in the rotation speed of the intermediate transfer belt 8 are offset by a variation in the driving speed of the driving roller 12, which stabilizes the rotation speed of the intermediate transfer belt 8.

In parallel with the feedback control, the control unit performs a reading control, i.e., reads information represented by the mark pattern. As explained above, the first mark 23*a* represents a point where reading of the mark pattern starts. On the other hand, each of the marks other than the first mark 23*a* represents any one numbers 0 to 9. For example, a length of the mark having 3 millimeters represents 0. Lengths of the mark of 4, 5, 6, 7, 8, 9, 10, 11, and 12 millimeters represents respectively 1, 2, 3, 4, 5, 6, 7, 8, and 9. The lengths of the second to the fourth marks 23*b* to 23*d* represent a three-digit number. For example, the lengths of the second to the fourth marks 23*b* to 23*d* of 5 millimeters, 3 millimeters, and 7 millimeters represents a three-digit number of 204.

The three digits represent a unit digit, the first place of decimals, and the second place of decimals of a value of a measured diameter of the roller member 14*a*. A design value of the diameter of the roller member 14*a* is 12 millimeters. However, the real diameter may have difference within a range of 9 millimeters and 12.1 millimeters. To represent the accurate value, the unit digit, the first place of decimals, and the second place of decimals of the measured diameter are represented by the three-digit number. The three-digit number of 204 represents that the measured diameter is 12.04 millimeters and is slightly larger than the design value. If the measured diameter is larger than the design value, the number of rotations of the tension roller 14 with respect to the rotation speed of the intermediate transfer belt 8 is smaller than a theoretical value, and accordingly, the rotation speed of the intermediate transfer belt 8 is calculated as a value smaller than the real value. If the measured diameter is 12.04 millimeters, the rotation speed of the intermediate transfer belt 8 is calculated as a value smaller than the real value by 0.3333%.

Based on the measured diameter of the roller member 14*a*, the control unit corrects the result of calculating the rotation speed of the intermediate transfer belt 8. Specifically, the lengths of the second to the fourth marks 23*b*, 23*c*, and 23*d* are calculated based on the detection times Tb, TC, and Td of the second to the fourth marks 23*b* to 23*d*. If the rotation speed of the intermediate transfer belt 8 varies, the detection times vary as well. However, as explained above, the change in the ratio of the detection times due to the variation in the rotation speed is small as long as the cause of the variation in the rotation speed is not an error. Therefore, as long as the print 100 operates in the normal state, the length of each mark can be appropriately obtained based on the ratio of the detection times of the marks even if the rotation speed of the intermediate transfer belt 8 varies in a steady state. More specifically, the control unit counts the detection times Tb, Tc, and Td based on a clock pulse of a microsecond order, and the values of the results of the detections are rounded off to a predetermined digit. This makes the values represented by the detection times Tb, Tc, and Td approximately equivalent to those of the lengths of the second to the fourth marks 23*b* to 23*d* even if the variation in the rotation speed occurs in a steady state. Because counting each detection time only once tends to results in a less accurate result of the counting, the control unit counts the detection times Tb, Tc, and Td for at least more than ten times and calculates an average of each of the detection times Tb, Tc, and Td. Based on the averages, the control unit calculates the lengths of the second to the fourth marks 23*b* to 23*d*. Subsequently, the control unit calculates a correction factor K of a belt rotation speed V of the intermediate transfer belt 8 based on a correction formula of (1+((a measured diameter−12)/12)×100). Thereafter, the result of calculating the belt rotation speed V based on the mark pattern is multiplied by the correction factor K to correct the belt rotation speed. For example, when the measured diameter is 12.04 millimeters, the correction factor K is 1.003333. Because the correction factor K is multiplied with the belt rotation speed V, the belt rotation speed V can be 1.003333 times and can be close to the real value.

The mark pattern of the printer 100 represents not only the measured diameter of the roller member 14*a* but also information on a model number of the tension roller 14. The model number is common among tension rollers that can be employed for the printer 100. If the value represented by the mark pattern represents a standard value, the tension roller 14 is an appropriate roller to the printer 100. The information on the model number is represented by a first-second distance between the first mark 23*a* and the second mark 23*b*, a second-third distance between the second mark 23*b* and the third mark 23*c*, a third-fourth distance between the third mark 23*c* and the fourth distance 23*d*, and a fourth-first distance between the fourth distance 23*d* and the first mark 23*a*.

Figure 14:
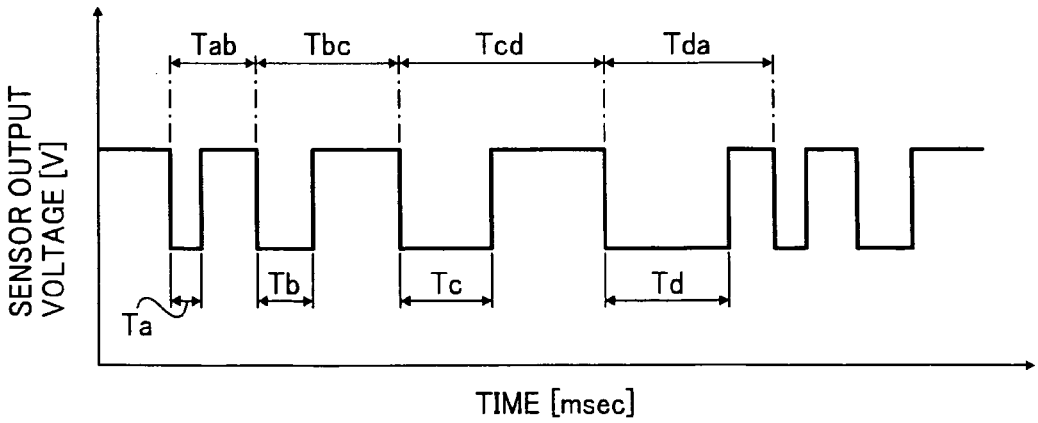
FIG. 14 is a graph for explaining a time from detecting a mark to detecting the next mark and a time during which a mark is detected.

Based on the above distances each between marks, the control unit specifies the model number of the tension roller 14. Specifically, as shown in FIG. 14, the optical sensor 21 detects a first-second detection time Tab from the detection of the tip portion of the first mark 23*a* to the detection of the tip portion of the second mark 23*b* for more than 10 times and an average thereof is calculated as in the case of detecting the detection times Ta to Td. Similarly, a second-third detection time Tbc from detecting the second mark 23*b* to detecting the third mark 23*c*, a third-fourth detection time Tcd from detecting the third mark 23*c* to detecting the fourth mark 23*d*, and a fourth-first detection time Tda from detecting the fourth mark 23*d* to detecting the first mark 23*a* are calculated. Based on the first-second detection time Tab, the second-third detection time Tbc, the third-fourth detection time Tcd, and the fourth-first detection time Tda, the first-second distance, the second-third distance, the third-fourth distance, and the fourth-first distance are calculated. The distances represent a four-digit model number.

After determining the model number, the control unit compares verification model number data and the model number. If the data and the model number do not match, the tension roller 14 is not an appropriate roller to the printer 100 and a print job is terminated. Thereafter, the control unit causes a display unit, such as a display, serving as a notifying unit to display information representing that the tension roller 14 is not an appropriate roller, and the information is provided to the user by voice.

Figure 15:
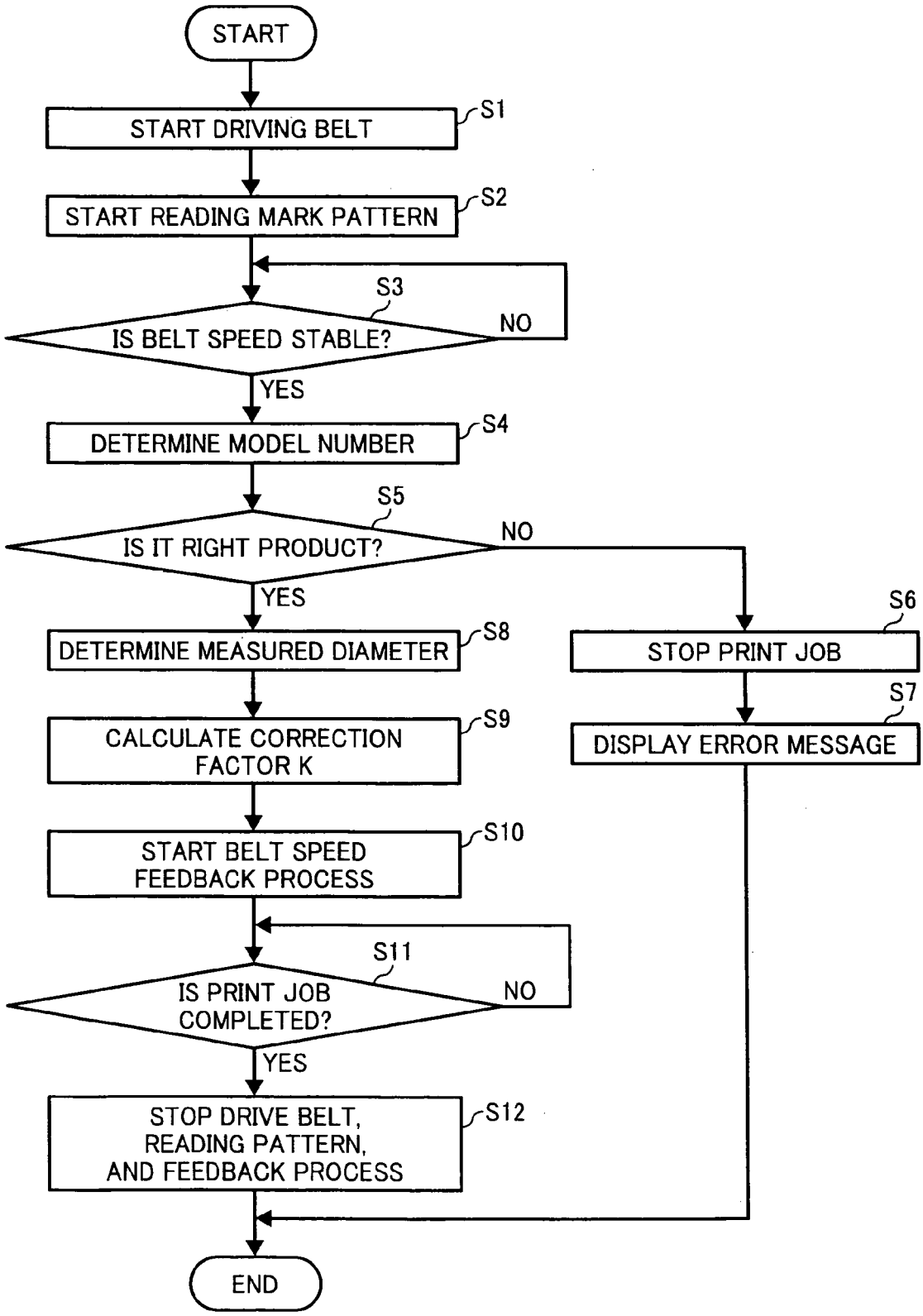
FIG. 15 is a flowchart of a part of a control performed by a control unit.

FIG. 15 is a flowchart of a part of a control performed by the control unit. The control unit starts a print job based on image information sent from an external personal computer, starts driving of the intermediate transfer belt 8 (step S1), and starts reading of the mark pattern (step S2). Based on a result of the reading, the control unit determines whether the belt rotation speed V is stable. If the belt rotation speed V is stable (YES at step S3), a model number of the tension roller 14 is determined in the process explained above based on the first-second detection time Tab and the like (step S4). The control unit compares a result of the determining the measured diameter and determines whether the tension roller 14 is an appropriate roller (step S5). If the control unit determines that the tension roller 14 is not an appropriate roller (NO at step S5), the control unit terminates the print job (step S6). Thereafter, the control unit causes the display unit to display an error message representing that the tension roller 14 is not an appropriate roller (step S7). On the other hand, if the control unit determines that the tension roller 14 is an appropriate roller (YES at step S5), the measured diameter of the tension roller 14 is determined in the process explained above (step S8). After calculating a correction factor K based on the result of determining the measured value (step S9), the control unit starts the feedback process, i.e., repeating calculating the belt moving speed V based on the mark pattern, correcting the rotation speed V by multiplying the rotation speed V with the correction factor K, and adjusting the rotation speed of the driving motor (step S10). In this manner, the rotation speed of the intermediate transfer belt 8 can be stabilized. Thereafter, after completing the print job (YES at step S11), the control unit terminates driving of the intermediate transfer belt 8, reading of the mark pattern, and the feedback process (step S12). In this manner, a series of a control flow ends.

Figure 16:
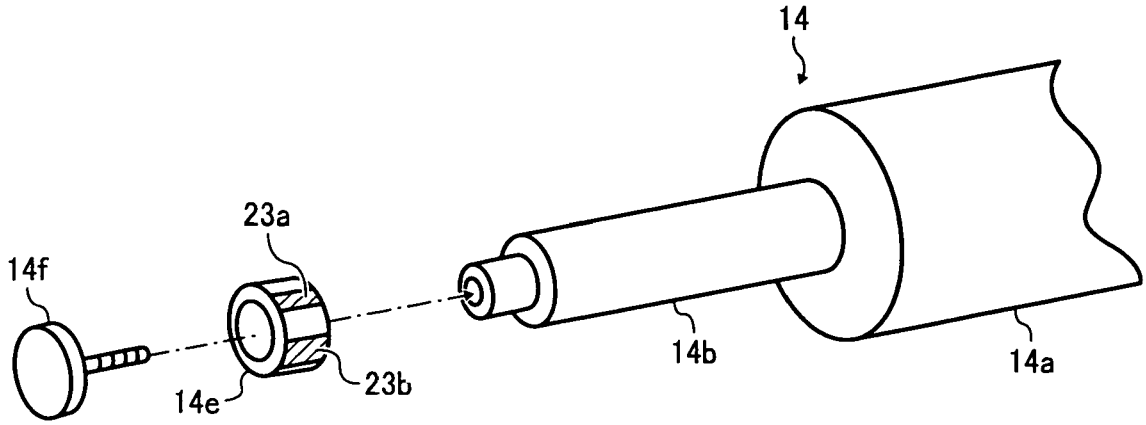
FIG. 16 is an exploded perspective view of one end of a tension roller of a printer according to Example 2.

FIG. 16 is an exploded perspective view of one end of the tension roller 14 of the printer 100 according to Example 2. The rotation shaft 14*b* of the tension roller 14 has a tip portion narrower than a base portion, i.e., the rotation shaft 14*b* consists of the tip portion and the base portion having a diameter larger than that of the tip portion. A mark holding member 14*e* with an outer circumference on which a mark pattern is provided is engaged with the tip potion of the rotation shaft 14*b*. The rotation shaft 14*b* has two spring holes and a fixing bolt is screwed into the spring hole. Therefore, the mark holding member 14*e* is fixed on the rotation shaft 14*b* between the top of a fixing bolt 14*f* and the base portion of the rotation shaft 14*b*. The mark pattern and the rotation shaft 14*b* can be easily separated by screwing down the fixing bolt 14*f* and detaching the mark holding member 14*e* from the rotation shaft 14*b*.

The mark pattern includes four marks as in the case of Example 1 and represents information on a serial number of the intermediate transfer belt 8. Specifically, while the lengths of the second mark 23*b*, the third mark 23*c*, and the fourth mark 23*d* represent a three-digit number and the first-second distance, the second-third distance, the third-fourth distance, and the fourth-first distance represent a four-digit number as in the case of the embodiment. In the printer of Example 2, a serial number is represented by an eight-digit number.

Figure 17:
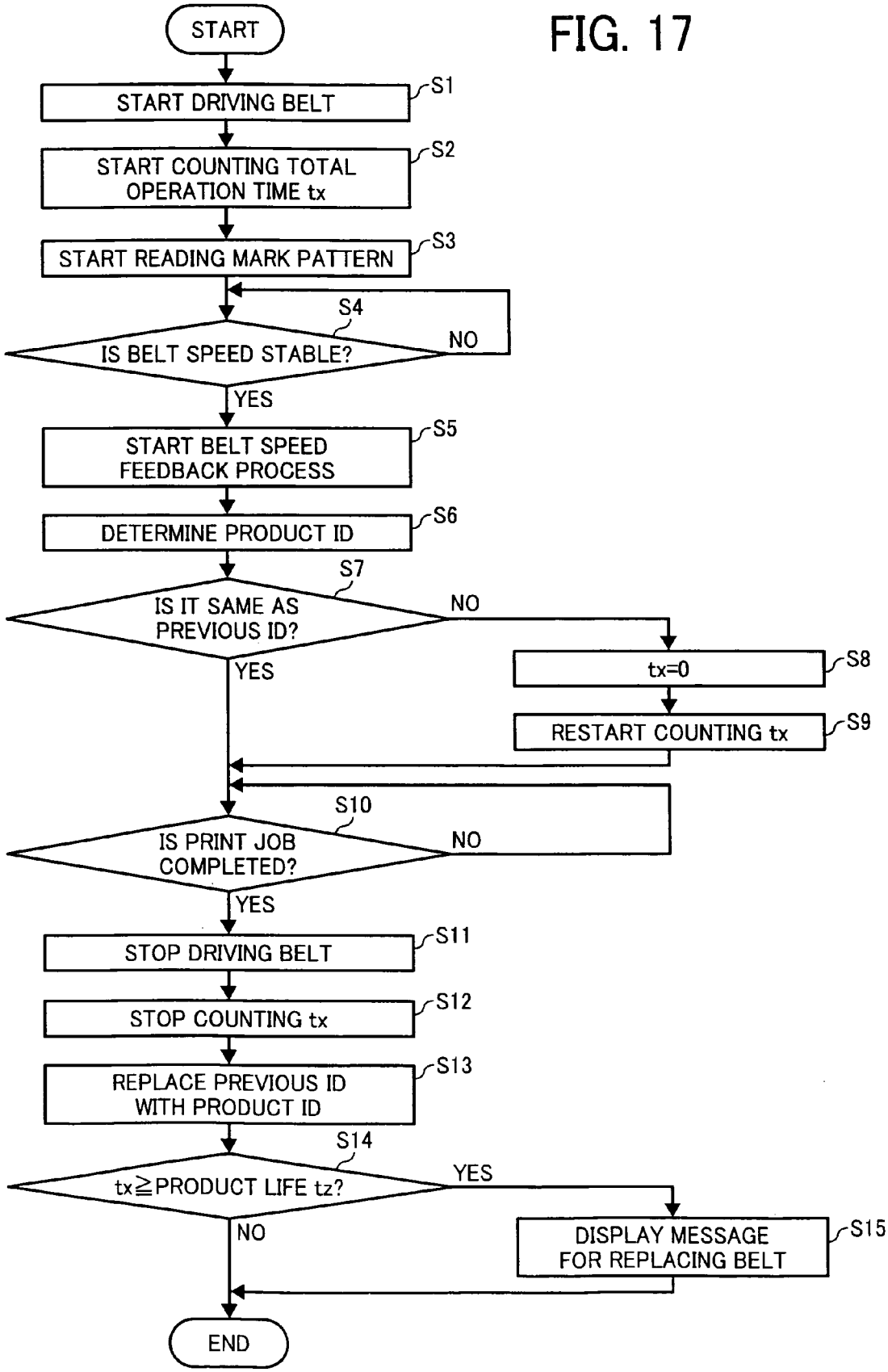
FIG. 17 is a flowchart of a part of a control performed by a control unit of the printer according to Example 2.

FIG. 17 is a flowchart of a part of a control performed by a control unit of a printer according to Example 2. The control unit starts a print job based on image information sent from an external personal computer and starts driving the intermediate transfer belt 8 (step S1). First, the control unit starts a count-up process of counting a total operation time tx of the intermediate transfer belt 8 (step S2). After starting reading the mark pattern (step S3), the control unit determines whether the belt rotation speed V is stable. When the belt rotation speed V is stable (YES at step S4), the control unit starts a speed feedback process (step S5). After determining the serial number of the intermediate transfer belt 8 based on the result of reading the mark pattern (step S6), the control unit determines whether the result of the determining the serial number at step S6 matches with a serial number that is stored in a RAM during the previous print job (step S7). If the result of the determining at step S6 does not match with the serial number previously stored in the RAM (NO at step S7), the intermediate transfer belt 8 is replaced. Once detecting the replacement of the intermediate transfer belt 8, the control unit resets a count-up value the total operation time tx of the intermediate transfer belt 8 to zero (step S8). Thereafter, the control unit restart the count-up process of counting a total operation time tx (step S9). On the other hand, if the result of the determining at step S6 matches with the serial number of the serial number previously stored in the RAM (YES at step S7), the count-up process is continued. Thereafter, the print job is completed (YES at step S10), the driving of the intermediate transfer belt 8 is terminated (step S11), and the count-up process is terminated (step S12). The serial number determined at step S6 is newly stored in the RAM and the serial number previously stored in the RAM is updated (step S13) and determines whether the total operation time tx reaches a product-life ending time tz (step S14). When the total operation time tx does not reach a product-life ending time tz yet (NO at step S14), the series of the control is terminated. On the other hand, when the total operation time tx reaches a product-life ending time tz (NO at step S14), the control unit causes the display unit to display a belt-replacing message for prompting a user to change the intermediate transfer belt 8 (step S15).

Figure 18:
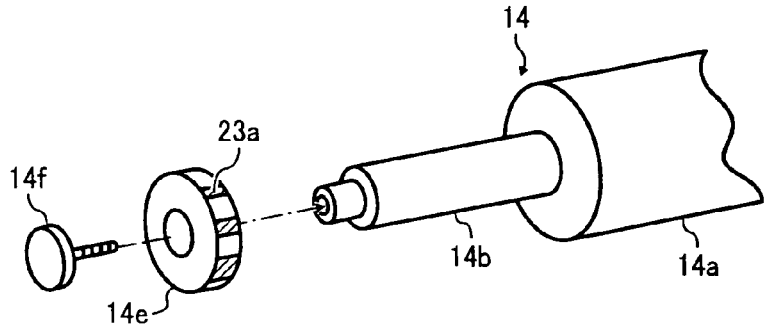
FIG. 18 is an exploded perspective view of one end of a tension roller 14 of a printer according to Example 3.

FIG. 18 is an exploded perspective view of one end of the tension roller 14 of a printer according to Example 3. The end of the tension roller 14 has a structure similar to that of Example 2. However, a diameter of the mark holding member 14*e* is larger than that of Example 2. Therefore, the mark holding member 14*e* of Example 3 has a diameter larger than that of Example 2, and a mark pattern having marks larger in number than those of Example 1 is provided to an outer circumference of the mark holding member 14*e*. In other words, the amount of information represented by the mark pattern of Example 3 is larger than that of Example 2. Specifically, in addition to the serial number of the intermediate transfer belt 8, a measured electric resistance or a model number of the intermediate transfer belt 8 is represented by the mark pattern of Example 3.

In addition to a control similar to that shown in FIG. 17, the control unit of the printer of Example 3 performs a right-product determination process and a primary-transfer bias adjusting process. Specifically, the control unit specifies not only the serial number but also the measured electric resistance and the model number of the intermediate transfer belt 8 at step S6 shown in FIG. 17. The control unit performs the right-product determination process and the primary-transfer bias adjusting process between step S6 and step S7 shown in FIG. 17.

In the right-product determination process, the control unit performs steps equivalent to steps S4 to S7 shown in FIG. 15 and determines whether the intermediate transfer belt 8 is an appropriate belt. When the intermediate transfer belt 8 is not an appropriate belt, the control unit terminates the print job and causes the display unit to display an error message.

In the primary-transfer bias adjusting process, a primary-transfer bias to be applied to each of the primary-transfer rollers 9Y, 9M, 9C, and 9K is adjusted based on a design value of the electric resistance of the intermediate transfer belt 8 that is previously stored in, for example, the ROM and a measured electric resistance determined based on the mark pattern. In addition, based on the difference between the design value and the measured electric resistance, a secondary-transfer bias to be applied to the secondary-transfer roller 19 is adjusted. This prevents an occurrence of an erroneous image transfer due to a deviation of the value of the transfer bias resulting from variations in an electric resistance of each product.

The mark pattern of the printer according to Example 4 represents a measured electric resistance and a model number of the primary-transfer roller 9K for black instead of the measured electric resistance and the model number of the intermediate transfer belt 8. Except for the above point, the printer is same as that of Example 3. This configuration prevents an occurrence of an erroneous image transfer due to a deviation of the value of the transfer bias resulting from a difference in an electric resistance of the primary-transfer roller 9K of each product.

In the printers of Example 1 to Example 4, the mark pattern represents specific information and the control unit is configured to determine the specific information, such as a model number, based on the result of detection of the mark pattern by the optical sensor 21 that is typically used for a belt-speed feedback control. Therefore, the specific information can be read without a dedicated sensor for reading the specific information.

In recent years, copy products of various types of members of an apparatus have been distributed on the market. The use of such a copy product may shorten the life of the apparatus because of low quality and low compatibility of the copy products. The number of manufacturers that take measures on this problem has been increasing and the most of the measures are taken with respect to a mechanical aspect. Specifically, for example, a hole is provided to a transfer belt for an inspection to be performed in a way that a jut provided to an apparatus is engaged with the hole to determine whether the transfer belt is not a copy product. However, such measures cannot solve the problem fundamentally because the mechanical structure can be easily copied. On the other hand, the tensions rollers of the printers according to Examples 1 to 4 cannot be easily copied because it is difficult to analyze the information represented by the mark patterns on the tensions rollers.

Figure 19:
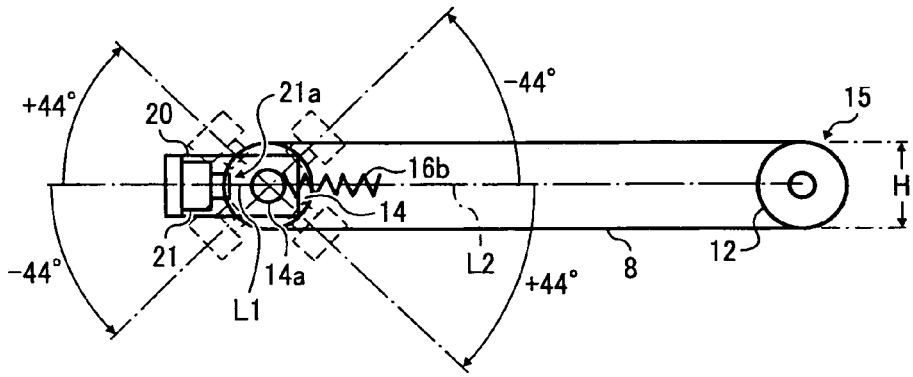
FIG. 19 is a schematic diagram of a transfer unit of a printer according to Example 5.

FIG. 19 is a schematic diagram of a transfer unit of a printer according to Example 5. In the printer, the intermediate transfer belt 8 is supported over only two rollers of the driving roller 12 and the tension roller 14. The tension roller 14 is positioned substantially same as the position of the cleaning backup roller 13 shown in FIG. 13 of the embodiment. In the printer of Example 5, the driving roller 12 functions also as a cleaning back-up roller, and a belt cleaning device (not shown) is in contact with a portion of the intermediate transfer belt 8 that is in contact with the driving roller 12.

A sliding bearing is formed in the sensor holder 20 that supports the optical sensor 21. Because the rotation shaft 14*b* of the tension roller 14 penetrates through the sliding bearing, the optical sensor 21 is supported by the rotation shaft 14*b*. The mark pattern provided on the outer circumference of the rotation shaft 14*b* is detected by the optical sensor 21. Because the mark pattern can be provided to the tension roller 14, the mark pattern can be accurately detected and the rotation speed of the intermediate transfer belt 8 can be stabilized even with the structure in which the intermediate transfer belt 8 is supported over only two rollers of the driving roller 12 and the tension roller 14 as shown in FIG. 19.

A virtual line L1 shown in FIG. 19 connects a mark detecting unit 21*a* of the optical sensor 21 and the rotation center of the tension roller 14, and a virtual line L2 shown in FIG. 19 connects the rotation center of the tension roller 14 and the rotation center of the driving roller 12. As shown in FIG. 19, the optical sensor 21 is positioned such that the virtual line L1 extends along the virtual line L2. Because of this positioning, the optical sensor 21 can be positioned in a space having a height H of the belt unit shown in FIG. 19. In this manner, the optical sensor 21 can be prevented from protruding from the belt unit with respect to the height H, which prevents an increase in a space of the belt unit. By providing the optical sensor 21 such that the virtual line L1 has an angle within a range of 44 degrees on the rotation axis of the tension roller 14 with respect to the virtual line L2, it is possible to reduce the deviation of the optical sensor 21 from the belt unit with respect to the height H compared with the case of providing the optical sensor 21 such that the virtual line L1 has an angle within a range not less than 45° on the rotation axis of the tension roller 14 with respect to the virtual line L2.

Figure 20:
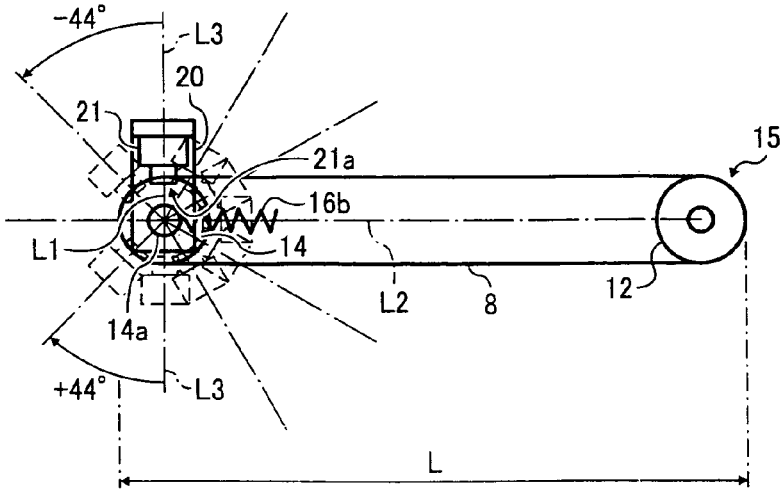
FIG. 20 is a schematic diagram of a transfer unit of a printer according to Example 6.

FIG. 20 is a schematic diagram of a transfer unit of a printer according to Example 6. As in the case of Example 5, the intermediate transfer belt 8 of the printer is supported over only two rollers of the driving roller 12 and the tension roller 14. A virtual lien L1 shown in FIG. 20 connects the mark detecting unit 21*a* and the rotation center of the tension roller 14, a virtual line L2 shown in FIG. 20 connects the rotation center of the tension roller 14 and the rotation center of the driving roller 12, and a virtual orthogonal line L3 shown in FIG. 20 is orthogonal to the virtual line L2. The optical sensor 21 is positioned such that the virtual line L1 extends along the virtual orthogonal line L3. Because of this positioning, the optical sensor 21 can be positioned in a space having a length L of the belt unit shown in FIG. 20. In this manner, the optical sensor 21 can be prevented from deviating from the belt unit with respect to the length L of the belt unit, which prevents an increase in a space of the belt unit. By providing the optical sensor 21 such that the virtual line L1 is on an orbit on the rotation center of the tension roller 14 on the side of the driving roller 12 with respect to the virtual orthogonal line L3, or such that the virtual line L1 is on the orbit on the rotation center of the tension roller 14 on the side opposite to the side of the tension roller 14 with respect to the virtual orthogonal line L3 and the virtual line L1 has an angle of 44 degrees or less with respect to the virtual orthogonal line L3, it is possible to reduce the deviation of the optical sensor 21 from the belt unit with respect to the length L compared with other cases in which the optical sensor 21 is positioned in a different manner.

Figure 21A:
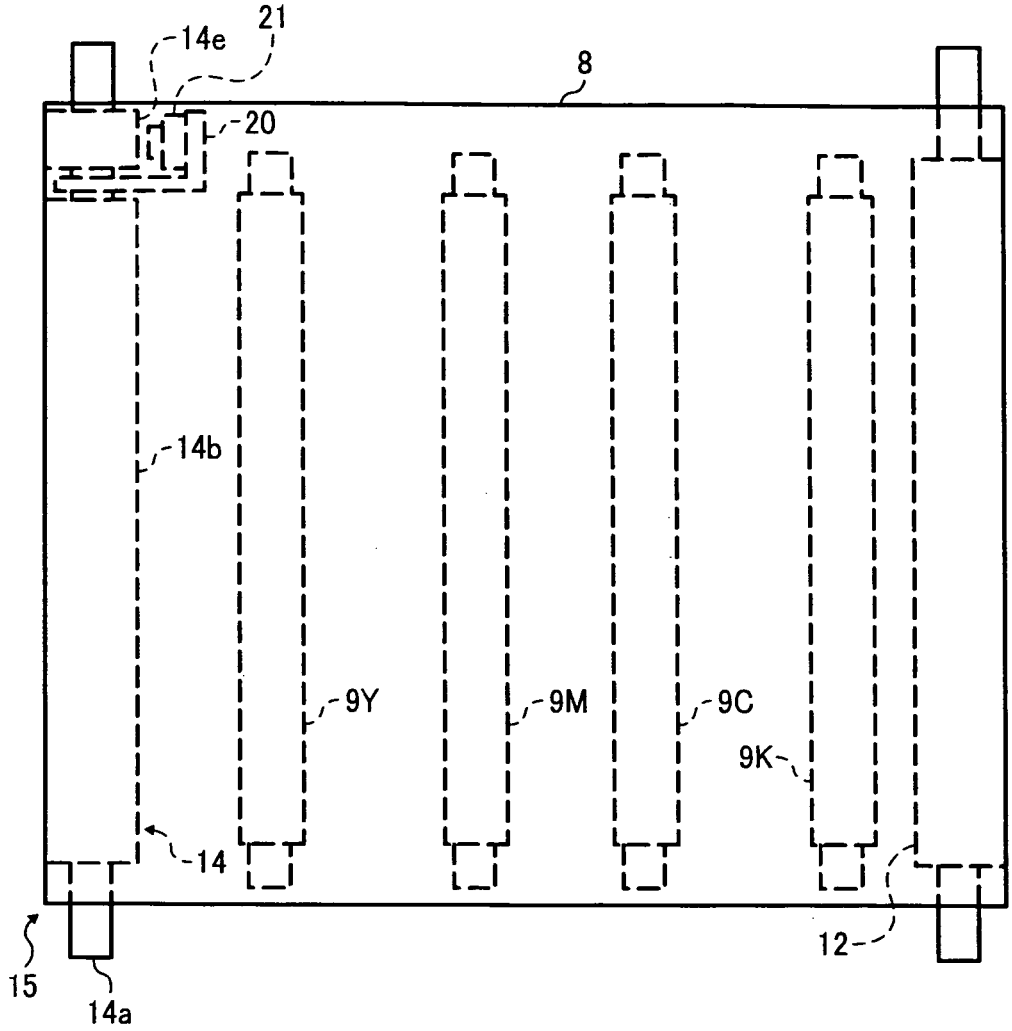
FIGS. 21A and 21B are schematic diagrams of a transfer unit of a printer according to Example 7.
Figure 21B:
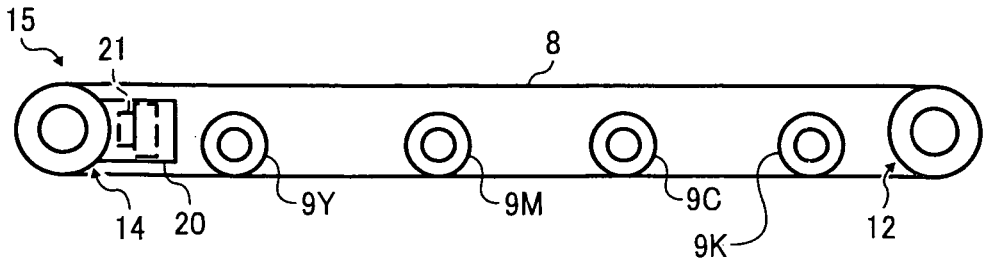

FIGS. 21A and 21B are schematic diagrams of the transfer unit 15 of a printer according to Example 7. As in the case of Example 5 and Example 6, the intermediate transfer belt 8 of the printer is supported over only two rollers of the driving roller 12 and the tension roller 14. As shown in FIG. 21, the optical sensor 21 is positioned in the loop of the intermediate transfer belt 8. This positioning is achieved because, as in the case of Example 5, the optical sensor 21 is positioned such that a virtual line connecting the optical sensor 21 and the rotation center of the tension roller 14 extends along a virtual line connecting the rotation center of the tension roller 14 and the rotation center of the driving roller 12. By positioning the optical sensor 21 in the loop of the intermediate transfer belt 8, it is possible to prevent an increase in the space of the belt unit of the transfer unit 15 that would otherwise be caused because of the deviation of the optical sensor 21 from the belt unit.

The marks provided to each of the tension rollers 14 of the printers of Examples 1 to 4 are provided at different pitches and have different lengths in the direction in which the tension roller 14 rotates, and specific information is represented based on the lengths or the pitches, or based on both of the length and the pitches. Because the control unit is determines specific information such as a model number based on the result of detecting the lengths and the pitches by use of the optical sensor 21, the specific information can be read without a dedicated sensor for reading the specific information.

Each of the tension rollers 14 of Examples 2 to 4 includes the mark holding member 14*e* detachably attached to the rotation shaft 14*b* and including the first to the fourth marks 23*a* to 23*d*. Even if the replacement of the tension roller 14 is required, it is possible to continuously use the mark pattern because the mark pattern can be detached from the old roller and attached to a new tension roller. Therefore, the mark pattern can represent information on a member other than the tension roller 14, such as the model number of the intermediate transfer belt 8.

In the printer of Example 1, the specific information represented by the mark pattern is the information on the measured diameter of the roller member 14*a*. Therefore, by correcting the difference between the real belt rotating speed and the result of calculating the belt rotation speed, which is caused due to the difference between the design value of the diameter and the measured diameter, the belt rotation speed can be accurately calculated. Therefore, the intermediate transfer belt 8 can be driven at an optimum speed, which increases the image quality.

In each of the printers according to Examples 2 to 4, the specific information represented by the mark pattern is on the intermediate transfer belt 8 or the primary-transfer roller 9K other than the tension roller 14. The rotation speed of the intermediate transfer belt 8 is detected based on the result of detecting the mark pattern of the tension roller 14. In addition, with the mark pattern, the information on the intermediate transfer belt 8 or the primary-transfer roller 9K can be managed.

Each of the printers according to Examples 1 to 4 includes the cover member 11 that covers the optical sensor and the marks. With this structure, the marks are prevented from being defiled due to dust or toner, which suppresses an error in detecting the mark pattern due to the defiling.

In each of the printers according to Examples 5 to 7, only the two rollers of the driving roller 12 and the tension roller 14 are used as supporting rollers over which the intermediate transfer belt 8 is supported. Therefore, the transfer unit can be downsized compared to a printer including at least three supporting rollers.

In the printer according to Example 5, the optical sensor 21 is provided such that the virtual line L1 extends along the direction in which the rotation center of the tension roller 14 and the rotation center of the driving roller 12 are connected, or such that the virtual line L1 has an angle of 44 degrees or less on the rotation axis of the tension roller 14 with respect to the virtual line L2. With this structure, as described above, it is possible to reduce the deviation of the optical sensor 21 from the belt unit with respect to the height of the belt unit compared with the case of providing the optical sensor 21 such that the virtual line L1 has an angle of 45° or more on the rotation axis of the tension roller 14 with respect to the virtual line 2.

In the printer according to Example 6, the optical sensor 21 is positioned such that the virtual line L1 extends along the virtual orthogonal line L3, such that the virtual line 1 the virtual line L1 is on the orbit on the rotation center of the tension roller 14 on the side of the tension roller 12 with respect to the virtual orthogonal line L3, or such that the virtual line L1 is on the orbit on the rotation center of the tension roller 14 on the side opposite to the side of the tension roller 14 with respect to the virtual orthogonal line L3 and the virtual line L1 has an angle 44 degrees or less with respect to the virtual orthogonal line L3. This positioning makes it possible to reduce the deviation of the optical sensor 21 from the belt unit with respect to the height of the belt unit.

In the printer according to Example 7, because the optical sensor 21 is positioned in the loop of the intermediate transfer belt 8, it is possible to prevent an increase in the space of the belt unit, thereby preventing an increase in the space of the belt unit.

In each of the printers according to Examples 2 to 4, the control unit is configured to automatically detect the replacement of a specific member of the image forming apparatus such as the intermediate transfer belt 8 or the primary-transfer roller 9K. Therefore, the user needs not spare time to input information on the replacement.

The printer according to Examples 3 includes a transfer-condition changing unit (a transfer-bias power circuit (304)) that changes conditions on an image transfer performed by the transfer unit 15. The mark pattern represents information on the specific member, i.e., the measured electric resistance of the intermediate transfer belt 8, and the control unit controls the transfer-condition changing unit 304 based on the information. This configuration suppresses variations in the electric resistance of each product of the intermediate transfer belt 8, which suppresses a deviation of the transfer bias from a desirable value. As a result, erroneous image transfer can be prevented.

The printer according to Examples 4 includes transfer-condition changing unit 304 that changes conditions on an image transfer performed by the transfer unit 15, and the primary-transfer roller 9K that is in contact with the inner surface of the intermediate transfer belt 8 while a transfer bias is applied to the primary-transfer roller 9K to transfer a visible K toner image on the photosensitive element 1K. The mark pattern represents information on the specific member, i.e., the information on the electric resistance of the primary-transfer roller 9K, and the control unit controls the transfer-condition changing unit 304 based on the information. This configuration suppresses variations in the electric resistance of each product of the primary-transfer roller 9K, which suppresses a deviation of the transfer bias from a desired value. As a result, erroneous image transfer can be prevented.

In the printers according to Examples 1 to 4, the control unit is configured to determine whether the specific member (i.e., the tension roller 14, the intermediate transfer belt 8, or the primary-transfer roller 9K) is a right product based on a result of detecting the model number obtained based on the mark pattern. With this configuration, it is possible to detect an installation of a copy product.

The control units of the printers according to Examples 1 to 4 are each configured to stop the driving of the specific member (i.e., the tension roller 14, the intermediate transfer belt 8, or the primary-transfer roller 9K) if the control unit determines that the specific member is not a right product. Therefore, it is possible to prevent shortening the life of the apparatus due to the use of a copy product.

The printers according to Examples 1 to 4 includes the display unit serving as an notifying unit, and the control units according to Examples 1 to 4 are each configured to cause the display unit to display the error message if the intermediate transfer belt 8, or the primary-transfer roller 9K is not a right product. Therefore, it is possible to prevent shortening the life of the apparatus due to the use of a copy product. In this manner, the user can be informed that the member is a copy product.

As described above, according to an aspect of the present invention, because the detecting unit is held by the tension roller, the detecting unit can move along with the tension roller. Therefore, even if the tension roller moves due to a bias from the belt member, the relative positions of the marks and the detecting unit are fixed. This structure increases the degree of freedom in layout of the tension roller to which the marks are provided, and the rotation speed of the belt member can be stable because the detecting unit detects the marks accurately.

Furthermore, according to another aspect of the present invention, because the detecting unit detects the marks, the rotation speed of the belt member is detected and the specific information is read that is represented by the mark pattern including the marks having the different lengths or provided at different pitches, or including the marks having the different lengths and provided at different pitches. In other words, without a dedicated sensor, the information represented by the mark pattern can be read by the optical sensor that is typically used for the belt speed feedback control. Even if the marks have different lengths and are provided at different pitches, it is possible to precisely control the rotation speed of the belt member in the following manner. Even if the lengths of the marks are different, by positioning at uniform pitches the tops or the bottoms of the marks in the direction in which the marks revolve in the direction in which the tension roller rotates, it is possible to accurately determining the rotation speed of the belt member based on the time intervals of detections of the tops or the ends of the marks. While the tops (ends) of the marks are positioned at the uniform pitches, the ends (tops) of the marks are positioned at different pitches because the marks have the different lengths, i.e., the lengths of the marks are not uniform. Such differences in length can represent specific information. Even if both of the tops and the ends of the marks are positioned at different pitches, it is possible to accurately determining the rotation speed of the belt member based on a time required for one rotation of each of the marks or a standard mark out of the marks (i.e., a time from firstly detecting a mark to secondarily detecting the mark).

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A device for driving a belt, the device comprising:

an endless belt member;

a plurality of supporting rollers over which the endless belt member is supported, the supporting rollers include at least a driving roller that drives the endless belt member and a driven roller that is driven by a rotation of the endless belt member;

a driving unit that drives the driving roller;

a plurality of marks provided on the driven roller, the marks representing predetermined information using a pattern of varying lengths and pitches;

a detecting unit that detects the marks on the driven roller at a predetermined position; and a control unit that controls a speed at which the driving unit drives the endless belt member based on a result of detecting the marks by the detecting unit, wherein the driven roller functions as a tension roller that applies a tension to the endless belt member, and the detecting unit is held by the tension roller.

2. The device according to claim 1, wherein the control unit determines the predetermined information by detecting the pattern.

3. The device according to claim 2, further comprising a mark holding member that holds the marks, wherein the tension roller includes a rotation shaft member, and the mark holding member is attached to the rotation shaft member in a detachable manner.

4. The device according to claim 2, wherein the tension roller includes a roller member, and the predetermined information is information on a measured diameter of the roller member.

5. The device according to claim 2, wherein the predetermined information is information regarding a member other than the driven roller.

6. The device according to claim 2, further comprising a cover member for covering the detecting unit and the marks.

7. The device according to claim 2, wherein the detecting unit includes a mark detecting member, and the detecting unit is arranged such that a virtual line connecting the mark detecting member and a rotation center of the driving roller extends along a rotation-center-connecting direction in which the rotation center of the driving roller and a rotation center of the tension roller are connected, or such that the virtual line has an angle with a range of 44 degrees on the rotation center of the tension roller with respect to the rotation-center-connecting direction.

8. The device according to claim 2, wherein the detecting unit includes a mark detecting member, and the detecting unit is arranged, such that a first virtual line connecting the mark detecting member and a rotation center of the driving roller extends along a virtual orthogonal line that is orthogonal to a second virtual line connecting a rotation center of the tension roller and the rotation center of the driving roller, such that the first virtual line is on an orbit on the rotation center of the tension roller on a side of the tension roller with respect to the virtual orthogonal line, or such that the first virtual line is on the orbit on the rotation center of the tension roller on the side opposite to the side of the tension roller with respect to the virtual orthogonal line and has an angle of 44 degrees or less with respect to the virtual orthogonal line.

9. The device according to claim 2, wherein the detecting unit is provided in a loop of the endless belt member.

10. The device of claim 1, wherein, the supporting rollers are bridged between a unit front plate and a unit back plate, and the driven roller is slidably supported by the unit front plate and the unit back plate.

11. The device according to claim 1, wherein the predetermined information includes information used to determine if the speed of the endless belt member is stable.

12. The device according to claim 1, wherein the marks include a first mark with a different length and pitch than the other marks, the first mark indicating a starting point of the pattern.

13. An image forming apparatus comprising:

a belt driving device including an endless belt member, a plurality of supporting rollers over which the endless belt member is supported, the supporting rollers include at least a driving roller that drives the endless belt member and a driven roller that is driven by a rotation of the endless belt member, a driving unit that drives the driving roller, a plurality of marks provided on the driven roller, the marks representing predetermined information using a pattern of varying lengths and pitches, a detecting unit that detects the marks on the driven roller at a predetermined position, and a control unit that controls a speed at which the driving unit drives the endless belt member based on a result of detecting the marks by the detecting unit, wherein the driven roller functions as a tension roller that applies a tension to the endless belt member, and the detecting unit is held by the tension roller;

an image carrier that carries an electrostatic latent image;

a developing unit that develops the electrostatic latent image on the image carrier to obtain a visible image; and a transferring unit that transfers the visible image on the image carrier directly to a recording medium that is held on a surface of the endless belt member, or transfers the visible image on the image carrier to the endless belt member and transfers the visible image on the endless belt member to the recording medium.

14. The image forming apparatus according to claim 13, wherein the control unit determines the predetermined information by detecting the pattern, and the control unit is configured to detect a replacement of a predetermined part of the image forming apparatus based on a variation in the pattern.

15. The image forming apparatus according to claim 14, further comprising a condition changing unit that changes a transfer condition of the visible image by the transfer unit, wherein the predetermined part is the endless belt member, the predetermined information is information on a measured electric resistance of the endless belt member, and the control unit controls the condition changing unit based on the predetermined information.

16. The image forming apparatus according to claim 14, further comprising:

a transfer roller that is in contact with an inner surface of the endless belt member while a bias is applied to the transfer roller to transfer the visible image onto the endless belt member; and a condition changing unit that changes a condition for transferring the visible image by the transfer unit, wherein the predetermined information is information on an electric resistance of the transfer roller, and the control unit controls the condition changing unit based on the predetermined information.

17. The image forming apparatus according to claim 14, wherein the control unit determines whether the predetermined part is a right product based on the pattern.

18. The image forming apparatus according to claim 17, wherein the control unit terminates driving of the endless belt member by the driving unit when the control unit determines that the predetermined part is not a right product.

19. The image forming apparatus according to claim 17, further comprising an notifying unit that notifies information to a user, wherein when the control unit determines that the predetermined part is not a right product, the control unit notifies the user that the predetermined part is not a right product.

20. The device of claim 13, wherein, the supporting rollers are bridged between a unit front plate and a unit back plate, the driven roller is slidably supported by the unit front plate and the unit back plate, and the driven roller is configured to move slidably in a direction substantially parallel to a moving direction of the belt member through primary transfer nips formed between an outer surface of the belt member and the image carrier.

21. The image forming apparatus according to claim 13, wherein the predetermined information includes information used to determine if the speed of the endless belt member is stable.

22. The image forming apparatus according to claim 13, wherein the marks include a first mark with a different length and pitch than the other marks, the first mark indicating a starting point of the pattern.

* * * * *